US006252152B1

(12) United States Patent
Aoki et al.

(10) Patent No.: US 6,252,152 B1
(45) Date of Patent: Jun. 26, 2001

(54) AUTOMATIC COMPOSITION APPARATUS AND METHOD, AND STORAGE MEDIUM

(75) Inventors: Eiichiro Aoki; Toshio Sugiura, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/392,800

(22) Filed: Sep. 9, 1999

(30) Foreign Application Priority Data

Sep. 9, 1998 (JP) ..... 10-255487
Feb. 1, 1999 (JP) ..... 11-023877

(51) Int. Cl.[7] ..... G10H 7/00

(52) U.S. Cl. ..... 84/609; 84/610; 84/634; 84/649; 84/650; 84/666

(58) Field of Search ..... 84/600–606, 609–614, 84/615, 618, 634–637, 649–652, 653, 656, 666–669, 477 R, DIG. 6

(56) References Cited

U.S. PATENT DOCUMENTS

| | | | | |
|---|---|---|---|---|
| 4,399,731 | | 8/1983 | Aoki | 84/609 |
| 5,375,501 | * | 12/1994 | Okuda | 84/611 |
| 5,451,709 | | 9/1995 | Minamitaka | 84/609 |
| 5,705,761 | | 1/1998 | Minamitaka | 84/609 |
| 5,736,663 | | 4/1998 | Aoki et al. | 84/609 |

FOREIGN PATENT DOCUMENTS

| | | |
|---|---|---|
| 60-40027 | 9/1985 | (JP) . |
| 9-50278 | 2/1997 | (JP) . |

* cited by examiner

*Primary Examiner*—Robert E. Nappi
*Assistant Examiner*—Marlon T. Fletcher
(74) *Attorney, Agent, or Firm*—Rossi & Associates

(57) ABSTRACT

Automatic composition apparatus and method is able to automatically compose a piece of music having a melody that is favorable in a musical sense, namely, a melody that satisfies musical requirements. A storage medium stores a program executed for automatically composing a piece of music having such a melody as described above. After melody pitches are generated under moderate first melody generation conditions, the generated melody pitches are evaluated in terms of more strict second melody generation conditions. With regard to a certain pitch, therefore, it can be determined whether the pitch satisfies musical requirements in view of not only the previous pitch but also the next pitch, thus making it possible to compose a piece of music that as a whole is favorable in a musical sense. Further, since the melody generated in the first stage only includes pitches that meet less strict melody generating conditions, the same melody is less likely to be rejected in the evaluation of the second stage, assuring high efficiency with which melody generation can be accomplished.

23 Claims, 18 Drawing Sheets

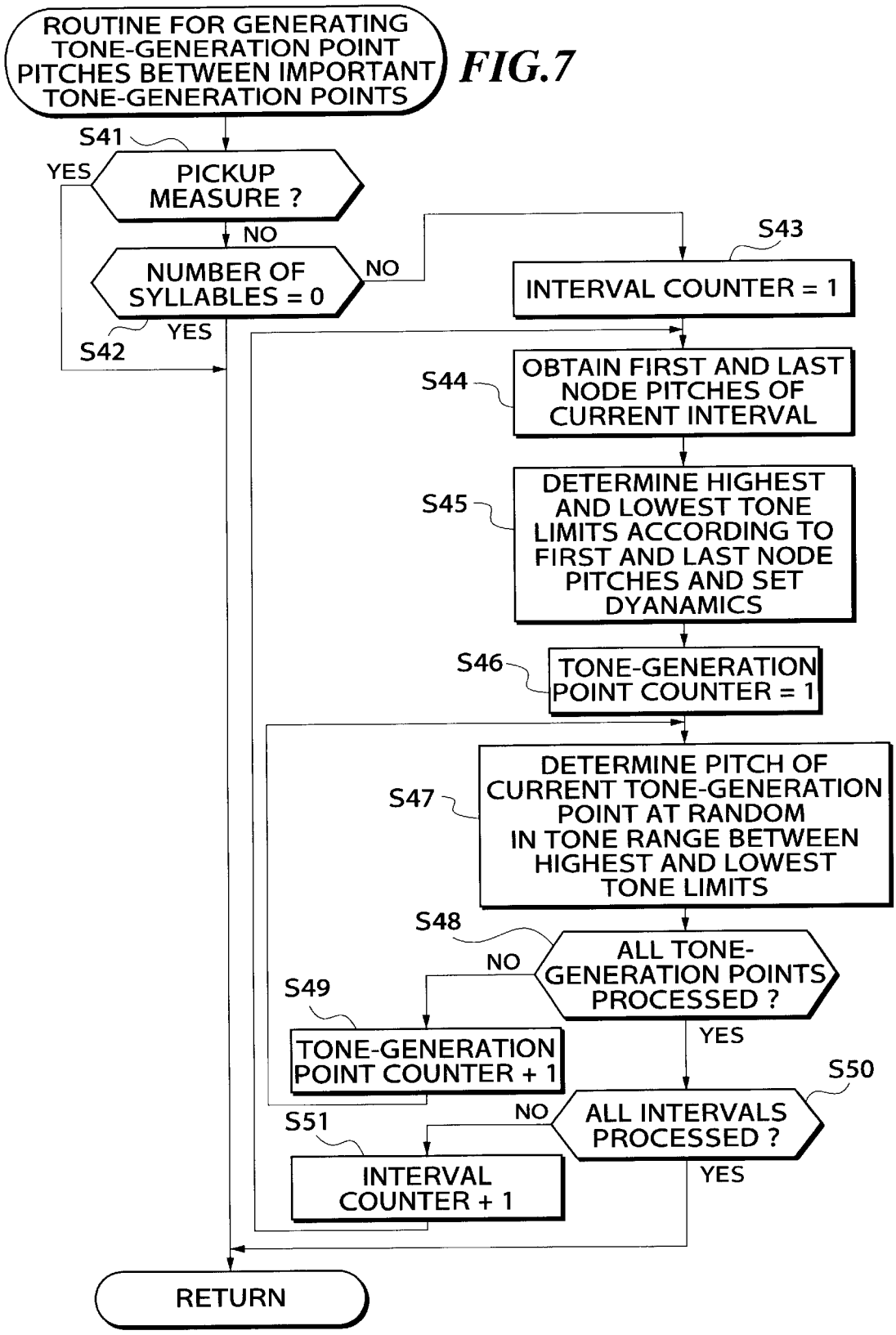
ROUTINE FOR GENERATING TONE-GENERATION POINT PITCHES BETWEEN IMPORTANT TONE-GENERATION POINTS
FIG.7
S41
PICKUP MEASURE ?
YES
NO
NUMBER OF SYLLABLES = 0
NO
YES
S42
S43
INTERVAL COUNTER = 1
S44
OBTAIN FIRST AND LAST NODE PITCHES OF CURRENT INTERVAL
S45
DETERMINE HIGHEST AND LOWEST TONE LIMITS ACCORDING TO FIRST AND LAST NODE PITCHES AND SET DYANAMICS
S46
TONE-GENERATION POINT COUNTER = 1
S47
DETERMINE PITCH OF CURRENT TONE-GENERATION POINT AT RANDOM IN TONE RANGE BETWEEN HIGHEST AND LOWEST TONE LIMITS
S48
ALL TONE-GENERATION POINTS PROCESSED ?
NO
YES
S49
TONE-GENERATION POINT COUNTER + 1
S50
ALL INTERVALS PROCESSED ?
NO
YES
S51
INTERVAL COUNTER + 1
RETURN

DYNAMICS = 0

DYNAMICS = 1

DYNAMICS = 2

DYNAMICS = 3

*FIG.14*

| MOTION | PITCH CURVE | CONJUNCT MOTION TO PHRASE FIRST TONE | UPWARD SKIP TO PHRASE FIRST TONE | DOWNWARD SKIP TO PHRASE FIRST TONE |
|---|---|---|---|---|
| HORIZONTAL MOTION | — | 000 | 001 | 002 |
| CONJUNCT UPWARD MOTION | \ | 010 | 011 | 012 |
| CONJUNCT DOWNWARD MOTION | / | 020 | 021 | 022 |
| ARPEGGIC UPWARD MOTION | \ | 030 | | 032 |
| ARPEGGIC DOWNWARD MOTION | / | 040 | 041 | |
| PROJECTED MOTION | ⟨ | 050 | 051 | 052 |
| PROJECTED MOTION WITH SKIP IN PICKUP | | 060 | | |
| RECESSED MOTION | ⟩ | 070 | 071 | 072 |
| RECESSED MOTION WITH SKIP IN PICKUP | | 080 | | |
| PROJECTED AND RECESSED MOTION | ≀ | 090 | 091 | 092 |
| RECESSED AND PROJECTED MOTION | ≀ | 100 | 101 | 102 |

AUTOMATIC COMPOSITION APPARATUS AND METHOD, AND STORAGE MEDIUM

BACKGROUND OF THE INVENTION

1. Field of the Invention

The present invention relates to an automatic composition apparatus and method for automatically composing a piece of music according to various conditions relating to music, and a storage medium that stores a program to be executed for automatically composing a piece of music.

2. Prior Art

A known automatic composition apparatus for automatically composing a piece of music according to various conditions relating to music is disclosed in, for example, laid-open Japanese Patent Publication (Kokai) No. 9-50278 and corresponding U.S. Pat. No. 5,736,663.

The automatic composition apparatus disclosed in the above-identified publication or U.S. patent is adapted to analyze and extract musical features of an already-composed piece of music, and store the results of the analyzing and extracting process as a music template into a performance data memory. The known apparatus enables the user to suitably modify a music template selected from various music templates stored in the memory, to thereby automatically compose a piece of music based on the template that has been modified.

The data contained in the music template includes those related to pitches of each phrase, including "pitch pattern of phrase", "first to last tones of phrase", and so forth. Based on these data, a pitch corresponding to each syllable in the phrase in question is determined. More specifically, where selected ones of the degrees (I, II, III, IV, V, VI, VII) are set for the "first to last tones of phrase", the pitches of the first and last syllables of the phrase in question are determined based on the set degrees. Where no degree is set for the "first to last tones of phrase", the pitches of the first and last syllables of the phrase in question are determined based on "emotional fluctuations" contained in the music template. Where a pitch pattern is set as the "pitch pattern of phrase" for the phrase in question, the pitches of syllables other than the first and last syllables of the phrase are determined based on this pitch pattern. Where no pitch pattern is set as the "pitch pattern of phrase" for the phrase in question, on the other hand, a pitch pattern that is approximate to a graphic pattern representing the "emotional fluctuation" is selected, and the pitches of the syllables are determined based on the selected pitch pattern. Once a melody is generated in this manner, the user judges whether there is any problem or disadvantage in the melody, by actually listening to the piece of music, and manually modifies the melody if there is any problem.

In another known automatic composition apparatus as disclosed in Japanese Patent Publication (Kokoku) No. 60-40027 and corresponding U.S. Pat. No. 4,399,731, pitches that are selected at random are examined in terms of certain musical conditions, and adopted to provide a melody of the music if they meet the musical conditions. If the selected pitches do not meet the musical conditions, pitches are selected at random again, to generate a melody.

In the former known automatic composition apparatuses as described above, a melody can be generated according to data contained in the music template, namely, data related to pitches for each phrase, but the resulting melody thus generated may be unfavorable in a musical sense or may not satisfy any musical requirement. If such a melody is generated, the user needs to manually modify the melody, which requires a cumbersome procedure.

In the latter known automatic composition apparatus, the randomly selected pitches are examined in terms of certain musical conditions, and only the pitches that meet the conditions are adopted or actually used in the piece of music. However, melodies generated in this manner are not always favorable in a musical sense, namely, do not always satisfy musical requirements. Namely, new pitches are determined only in view of the previous pitch and current pitch, and therefore musically unfavorable or undesirable pitches may be selected due to a failure to take account of the next pitch.

SUMMARY OF THE INVENTION

It is therefore an object of the present invention to provide automatic composition apparatus and method that is able to automatically compose a piece of music having a melody that is favorable in a musical sense, namely, a melody that satisfies musical requirements.

It is another object of the present invention to provide a storage medium that stores a program executed for automatically composing a piece of music having such a melody as described above.

The above objects may be accomplished according to a first aspect of the present invention, which provides an automatic composition apparatus comprising a melody pitch generating device that generates melody pitches of a piece of music to be composed, so that the melody pitches satisfy first melody generation conditions that are less strict than second melody generation conditions, and an evaluation device that evaluates the melody pitches generated by the melody pitch generating device, in terms of the second melody generation conditions, an automatic composition method comprising the steps of generating melody pitches of a piece of music to be composed, so that the melody pitches satisfy first melody generation conditions that are less strict than second melody generation conditions, and evaluating the generated melody pitches in terms of the second melody generation conditions, and a storage medium storing a program that is executable by a computer, comprising a melody pitch generating module that generates melody pitches of a piece of music to be composed, so that the melody pitches satisfy first melody generation conditions that are less strict than second melody generation conditions, and an evaluation module that evaluates the melody pitches generated by the melody pitch generating module, in terms of the second melody generation conditions.

With the apparatus, method and storage medium constructed as described above, after the melody pitches are generated under moderate first melody generation conditions, the generated melody pitches are evaluated in terms of more strict second melody generation conditions. With regard to a certain pitch, therefore, it can be determined whether the pitch satisfies musical requirements in view of not only the previous pitch but also the next pitch, thus making it possible to compose a piece of music that as a whole is favorable in a musical sense. Further, since the melody generated in the first stage only includes pitches that meet less strict melody generating conditions, the same melody is less likely to be rejected in the evaluation of the second stage, assuring high efficiency with which melody generation can be accomplished.

In a preferred form of the first aspect of the invention, the first melody generation conditions include dynamics, and the number of syllables, and the second melody generation conditions include various musical rules, and the frequency of non-chord tones.

The above objects may also be accomplished according to a second aspect of the present invention, which provides an automatic composition apparatus comprising a melody pitch generating device that generates melody pitches of a piece of music to be composed, for each of a plurality of sections into which the piece of music is divided, so that the melody pitches in each section satisfy first melody generation conditions that are less strict than second melody generation conditions, a linking device that links the plurality of sections each comprising the melody pitches generated by the melody pitch generating device, in a direction of progression of the piece of music, and an evaluation device that evaluates the melody pitches of the plurality of sections linked by the linking device, in terms of the second melody generation conditions, an automatic composition method comprising the steps of generating melody pitches of a piece of music to be composed, for each of a plurality of sections into which the piece of music is divided, so that the melody pitches in each section satisfy first melody generation conditions that are less strict than second melody generation conditions, linking the plurality of sections each comprising the generated melody pitches in a direction of progression of the piece of music, and evaluating the melody pitches of the linked plurality of sections in terms of the second melody generation conditions, and a storage medium storing a program that is executable by a computer, comprising a melody pitch generating module that generates melody pitches of a piece of music to be composed, for each of a plurality of sections into which the piece of music is divided, so that the melody pitches in each section satisfy first melody generation conditions that are less strict than second melody generation conditions, a linking module that links the plurality of sections each comprising the melody pitches generated by the melody pitch generating module, in a direction of progression of the piece of music, and an evaluation module that evaluates the melody pitches of the plurality of sections linked by the linking module, in terms of the second melody generation conditions.

With the apparatus, method and storage medium constructed as described above, after melody pitches are generated under moderate melody generation conditions, for each of a plurality of sections into which the piece of music is divided, the plurality of sections each containing the thus generated melody pitches are linked together, and the resulting melody is evaluated in terms of more strict second melody generation conditions. Namely, the evaluation is conducted with respect to each short section in terms of moderate conditions, and therefore a melody that satisfies the conditions can be relatively easily obtained (because it is easy to re-generate the melody pitches in the short section). Since the sections each satisfying the moderate conditions are linked together, melody pitches in a long section obtained by linking the short sections naturally satisfy the above moderate conditions. It is thus easy to obtain a melody that extends over a plurality of sections, and still satisfies the moderate conditions. For example, if the user attempts to create a melody that extends over a long period and also satisfies the conditions from the beginning, and only the tones in the last part of the period do not satisfy the conditions, he/she must re-create the melody from the beginning. If the short sections are linked together, only the section(s) that does not satisfy the conditions has only to be created again. Further, the melody that extends over a plurality of sections can be evaluated in terms of more strict conditions.

In a preferred form of the second aspect of the invention, the first melody generation conditions include dynamics, and the number of syllables, and the second melody generation conditions include various musical rules, and the frequency of non-chord tones.

The above objects may also be accomplished according to a third aspect of the present invention, which provides an automatic composition apparatus comprising a melody pitch generating device that generates melody pitches of a piece of music to be composed, so that the melody pitches satisfy predetermined melody generation conditions, an evaluating device that evaluates the melody pitches generated by the melody pitch generating device, and a control device that adopts the melody pitches generated by the melody pitch generating device when the melody pitches pass evaluation of the evaluating device, and adopts the melody pitches after modification thereof, if possible, when the melody pitches fail to pass the evaluation of the evaluating device, the control device generating a command to the melody pitch generating device to generate melody pitches again when the melody pitches originally generated by the melody pitch generating device fail to pass the evaluation and modification thereof is impossible, an automatic composition method comprising the steps of generating melody pitches of a piece of music to be composed, so that the melody pitches satisfy predetermined melody generation conditions, evaluating the generated melody pitches, and adopting the generated melody pitches when the melody pitches pass the evaluation, and adopting the generated melody pitches after modification thereof, if possible, when the melody pitches fail to pass the evaluation, while causing the step of generating melody pitches of the piece of music to be composed to generate melody pitches again when the melody pitches originally generated by the step of generating melody pitches of the piece of music to be composed fail to pass the evaluation and modification thereof is impossible, and a storage medium storing a program that is executable by a computer, comprising a melody pitch generating module that generates melody pitches of a piece of music so that the melody pitches satisfy predetermined melody generation conditions, an evaluating module that evaluates the melody pitches generated by the melody pitch generating module, and a control module that adopts the melody pitches generated by the melody pitch generating module when the melody pitches pass evaluation of the evaluating module, and adopts the melody pitches after modification thereof, if possible, when the melody pitches fail to pass the evaluation of the evaluating module, the control module generating a command to the melody pitch generating module to generate melody pitches again when the melody pitches originally generated by the melody pitch generating module fail to pass the evaluation and modification thereof is impossible.

With the apparatus, method and storage medium constructed as described above, the generated melody pitches are accepted and adopted in the piece of music if they pass the evaluation, and are modified, if possible, if they do not pass the evaluation. If the modification is not possible, the control flow returns to the initial step of generating melody pitches again. Thus, even if the melody pitches are once rejected in the evaluation, they may be modified to a certain degree to pass the evaluation, thus assuring a high efficiency in melody generation.

The above objects may be accomplished according to a fourth aspect of the present invention, which provides an automatic composition apparatus comprising a melody pitch generating device that generates melody pitches of a piece of music to be composed, a skeleton node pitch generating device that generates skeleton node pitches that form a skeleton of the piece of music to be composed, an important tone-generation point detecting device that detects important tone-generation points of the piece of music to be composed, and an allocating device that allocates the skeleton node pitches generated by the skeleton node pitch generating device, to the important tone-generation points detected by the important tone-generation point detecting device, wherein the melody pitch generating device generates the melody pitches based on the skeleton node pitches allocated to the important tone-generation points, an automatic composition method comprising the steps of generating melody pitches of a piece of music to be composed, generating skeleton node pitches that form a skeleton of the piece of music to be composed, detecting important tone-generation points of the piece of music to be composed, and allocating the generated skeleton node pitches to the detected important tone-generation points, wherein the step of generating melody pitches of the piece of music to be composed generates the melody pitches based on the skeleton node pitches allocated to the important tone-generation points, and a storage medium storing a program that is executable by a computer, comprising a melody pitch generating module that generates melody pitches of a piece of music to be composed, a skeleton node pitch generating module that generates skeleton node pitches that form a skeleton of the piece of music to be composed, an important tone-generation point detecting module that detects important tone-generation points of the piece of music to be composed, and an allocating module that allocates the skeleton node pitches generated by the skeleton node pitch generating module, to the important tone-generation points detected by the important tone-generation point detecting module, wherein the melody pitch generating module generates the melody pitches based on the skeleton node pitches allocated to the important tone-generation points.

With the apparatus, method and storage medium constructed as described above, the skeleton node pitches are allocated to the important tone-generation points, and therefore the skeleton can be reflected in the melody thus generated.

Preferably, the apparatus according to the fourth aspect of the invention further comprises a pitch range information setting device that sets pitch range information used when generating melody pitches between the important tone-generation points, the pitch range information representing a pitch range in which the melody pitches are to be included after being generated, and a pitch difference calculating device that calculates a pitch difference between the skeleton node pitches, wherein the melody pitch generating device generates the melody pitches between the important tone-generation points, according to the calculated pitch difference, the set pitch range information, and the skeleton node pitches.

In the above preferred form of the invention, the pitch range information is established, and the pitch difference between the skeleton node pitches is calculated, so that the melody pitches between the important tone-generation points are generated according to the calculated pitch difference, the established pitch range information, and the skeleton node pitches. Thus, the pitches of the tone-generation points between the important tone-generation points can be generated as desired or intended by the user.

Preferably, the apparatus according to the fourth aspect of the invention further comprises a pitch range information setting device that sets pitch range information used when generating melody pitches between the important tone-generation points, the pitch range information representing a pitch range in which the melody pitches are to be included after being generated, and a number-of-syllable setting device that sets a number of syllables between the important tone-generation points, wherein the melody pitch generating device generates the melody pitches between the important tone-generation points, according to the set number of syllables, the set pitch range information, and the skeleton node pitches.

In the above preferred form of the invention, the pitch range information is established, and the number of syllables between the important tone-generation points is set, so that the melody pitches between the important tone-generation points are generated according to the set number of syllables, the established pitch range information, and the skeleton node pitches. Thus, the pitches of the tone-generation points between the important tone-generation points can be generated as desired or intended by the user.

The above objects may also be accomplished according to a fifth aspect of the invention, which provides an automatic composition apparatus comprising a melody pitch generating device that generates melody pitches of a piece of music to be composed, the piece of music including pickup measures, and normal measures other than the pickup measures, wherein the melody pitch generating device performs individual operations to generate melody pitches for the pickup measures and generate melody pitches for the normal measures, according to respective algorithms that are independent of each other, an automatic composition method comprising the steps of generating melody pitches of a piece of music to be composed, the piece of music including pickup measures, and normal measures other than the pickup measures, wherein the step of generating melody pitches of the piece of music to be composed performs individual operations to generate melody pitches for the pickup measures and generate melody pitches for the normal measures, according to respective algorithms that are independent of each other, and a storage medium storing a program that is executable by a computer, comprising a melody pitch generating module that generates melody pitches of a piece of music to be composed, the piece of music including pickup measures and normal measures other than the pickup measures, wherein the melody pitch generating module performs individual operations to generate melody pitches for the pickup measures and generate melody pitches for the normal measures, according to respective algorithms that are independent of each other.

With the apparatus, method and storage medium constructed as described above, the melody pitches of the normal measures and the melody pitches of the pickup measures are generated independently of each other, thus making it possible to produce a wide variety of melodies containing pickup measures while satisfying musical requirements.

The above objects may be accomplished according to a sixth aspect of the present invention, which provides an automatic composition apparatus comprising a melody pitch generating device that generates melody pitches of a piece of music to be composed, and a display device that displays the generated melody pitches within a narrow range relative to the whole piece of music, and also displays indications each of which represents the length of one phrase and may extend over a plurality of measures, and an automatic composition method comprising the steps of generating melody pitches of a piece of music to be composed, and displaying the generated melody pitches within a narrow range relative to the whole piece of music, and also displaying indications each of which represents the length of one phrase and may extend over a plurality of measures.

With the apparatus and method constructed as described above, the generated melody pitches are displayed in a narrow range or area relative to the whole piece of music, which makes it easier for the user to take a general view of the melody. Also, the display device displays indications each of which represents the length of one phrase and may extend over a plurality of measures. Where the piece of music includes a pickup measure or measures, in particular, the user is able to easily recognize the beginning and end of the relevant phrase.

The above objects may be accomplished according to a seventh aspect of the present invention, which provides an automatic composition apparatus comprising a melody pitch generation device that generates melody pitches of a piece of music to be composed, and a display device that displays the generated melody pitches in a format in which one octave consists of seven tones that are scale tones of a key, the format including a #/♭ selection section in which sharp tones and flat tones, if any, are indicated, the display device being operable to display a selected one of # and ♭ in the #/♭ selection section when a corresponding one of the displayed melody pitches is other than the seven tones, and an automatic composition method comprising the steps of generating melody pitches of a piece of music to be composed, and displaying the generated melody pitches in a format in which one octave consists of seven tones that are scale tones of a key, the format including a #/♭ selection section in which sharp tones and flat tones, if any, are indicated, the step of displaying the generated melody pitches displaying a selected one of # and ♭ in the #/♭ selection section when a corresponding one of the displayed melody pitches is other than the seven tones.

With the apparatus and method constructed as described above, the generated melody pitches are displayed in a format in which one octave consists of seven tones that are scale tones of a key, and this format includes a #/♭ selection section that indicates sharp tones and flat tones, if any. The display device operates to display a selected one of # and ♭ in the #/♭ selection section when any of the melody pitches is other than the above seven tones. With this arrangement, the display area can be advantageously reduced as compared with the case where melody pitches are displayed with twelve tones per octave, thus permitting the use of a display device having a relatively narrow display area, which results in a reduction in the cost of the apparatus as a whole. Also, where a display device having the same display area is used, this device may have a reduced resolution, which also results in a reduced cost of the apparatus as a whole.

The above and other objects of the invention will become more apparent from the following drawings taken in conjunction with the accompanying drawings.

BRIEF DESCRIPTION OF THE DRAWINGS

FIG. 7 is a flowchart showing a detailed flow of a routine for generating pitches of tone-generation points between important tone-generation points, which provides the subroutine of FIG. 4 for creating a melody of the measure in question;

FIGS. 11A to 11D are views useful in explaining the process of determining the highest tone limit and the lowest tone limit of the interval in question, in which:

FIG. 11A shows the determining process in the case where dynamics is equal to 0;

FIG. 11B shows the determining process in the case where the dynamics is equal to 1;

FIG. 11C shows the determining process in the case where the dynamics is equal to 2; and FIG. 11D shows the determining process in the case where the dynamics is equal to 3;

FIG. 14 is a view showing various types of pitch curves available for selection;

DETAILED DESCRIPTION OF THE PREFERRED EMBODIMENTS

Preferred embodiments of the present invention will be described in detail with reference to the accompanying drawings.

Figure 1:
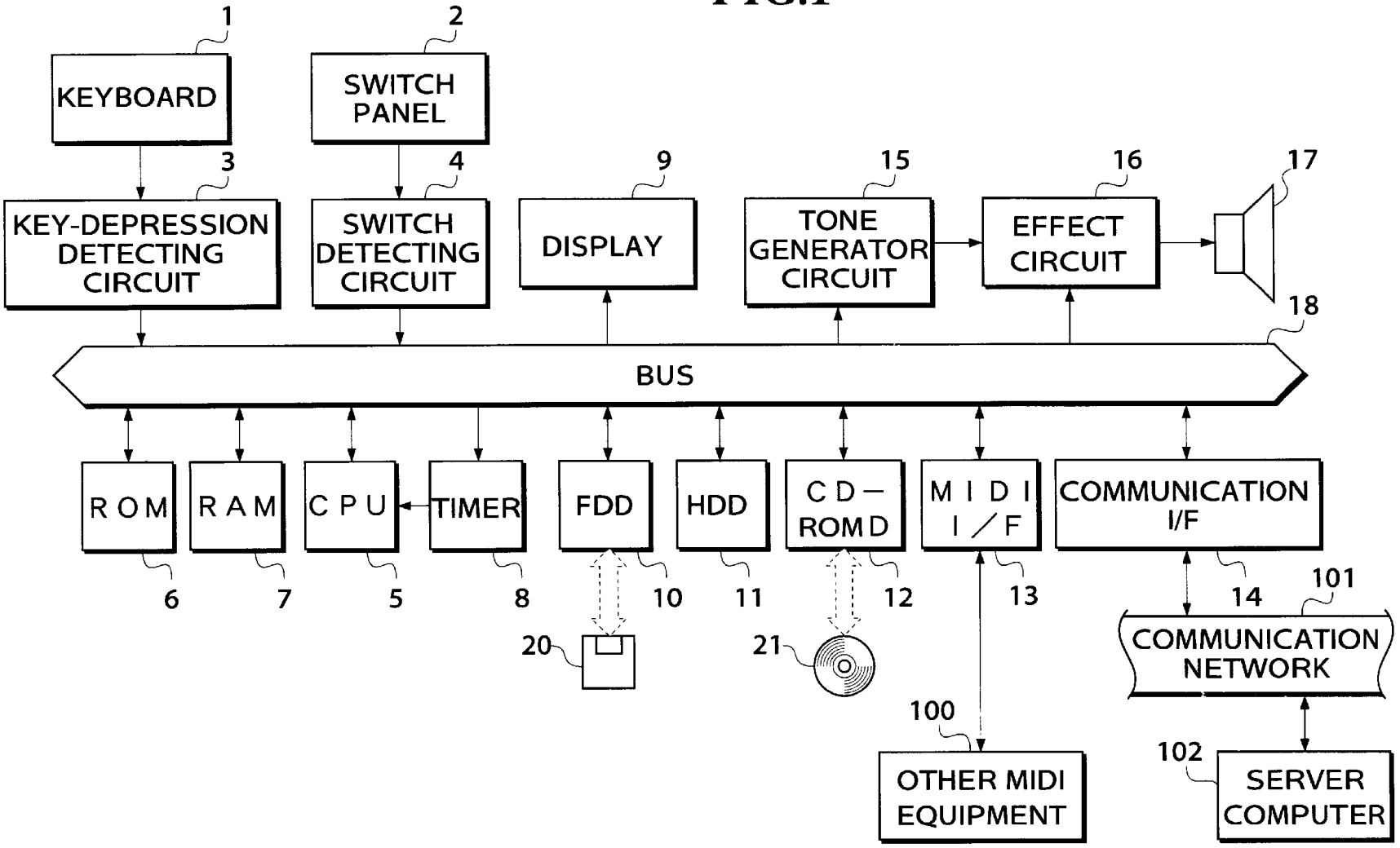
FIG. 1 is a block diagram schematically showing the construction of an automatic composition apparatus according to one embodiment of the present invention.

Referring first to FIG. 1, there is schematically shown the construction of an automatic composition apparatus according to one embodiment of the present invention.

As shown in FIG. 1, the automatic composition apparatus of the present embodiment includes a keyboard 1 through which pitch information is entered, a switch panel 2 including a plurality of switches (including a mouse serving as a pointing device) with which various types of information is entered, a key-depression detecting circuit 3 that detects the operated state of each key on the keyboard 1, and a switch detecting circuit 4 that detects the operated or depressed state of each switch on the switch panel 2. The automatic composition apparatus also includes CPU 5 that governs control of the whole apparatus, ROM 6 that stores control programs to be executed by the CPU 5, table data, and so forth, RAM 7 that temporarily stores performance data, various input information, and operation results, and a timer 8 that counts interrupt time during timer interrupt processing, and various periods of time. The present apparatus further includes a display device 9 for displaying various information, which includes, for example, a large-sized liquid crystal display (LCD) or CRT (cathode ray tube) display, and light emitting diodes (LED), a floppy disc drive (FDD) 10 for driving a floppy disc (FD) 20 as one type of storage medium, a hard disc drive (HDD) 11 for driving a hard disc (not shown) that may store various application programs including the above control programs, and various types of data, and a CD-ROM drive (CD-ROMD) 12 for driving a CD-ROM (compact disc-read only memory) 21 that may store various application programs including the above control programs, and various types of data. The apparatus further includes a MIDI interface (I/F) 13 that receives MD (Musical Instrument Digital Interface) signals from external devices or equipment, and generates MIDI signals to the external devices or equipment, a communication interface (I/F) 14 that transmits and receives data to and from a server computer 102, or the like, through a communication network 101, a tone generator circuit 15 that converts performance data entered through the keyboard 1, preset performance data, or the like, into musical tone signals, an effect circuit 16 that gives various sound effects to the tone signals received from the tone generator circuit 15, and a sound system 17 that converts the tone signals received from the effect circuit 16, into actual sound. The sound system 17 may consist of a DAC (Digital-to-Analog Converter), an amplifier, a loudspeaker, or the like.

In the apparatus of the present embodiment, the components 3–16 as indicated above are connected with each other via a bus 18. In addition, the timer 8 is connected to the CPU 5, and other MIDI equipment 100 is connected to the MIDI I/F 13, while the communication network 101 is connected to the communication I/F 14. Also, the effect circuit 16 is connected to the tone circuit 15, and the sound system 17 is connected to the effect circuit 16.

As described above, the hard disc mounted in the HDD 11 may store control programs to be executed by the CPU 5. Where a certain control program is not stored in the ROM 6, the hard disc may store the control program, which is read into the RAM 7 so that the CPU 5 can perform the same operation as in the case where the control program is stored in the ROM 6. In this manner, a new control program can be easily added, or an existing program that has been already installed can be easily upgraded.

A control program or various data may be read from the CD-ROM 21 set in the CD-ROM drive 12, and stored to the hard disc in the HDD 11. In this manner, a new control program can be easily installed, or an existing program can be easily upgraded. The present apparatus may be provided with other external storage devices, such as a magneto-optic disc (MO) device, that utilize various forms of storage media, in addition to or in place of the CD-ROM device 12.

As described above, the communication I/F 14 is connected to the communication network 101, such as LAN (Local Area Network), Internet, or a telephone line, so as to be connected to the server computer 102 via the communication network 101. In the case where a certain program or a certain set of parameters is not stored in the hard disc within the HDD 11, the communication I/F 14 may be used for downloading the program or parameters from the server computer 102. A client computer (i.e., automatic composition apparatus in the present embodiment) sends a command to the server computer 102 via the communication I/F 14 and communication network 101, to request downloading of a desired program or parameters. Upon receipt of the command, the server computer 102 delivers the requested program or set of parameters to the client computer, through the communication network 101. The client computer then receives the program or set of parameters through the communication I/F 14, and stores the same to the hard disc in the HDD 11. In this manner, downloading is accomplished.

It is also possible to provide another interface for transmitting and receiving data directly to and from an external computer, or the like.

Figure 2:
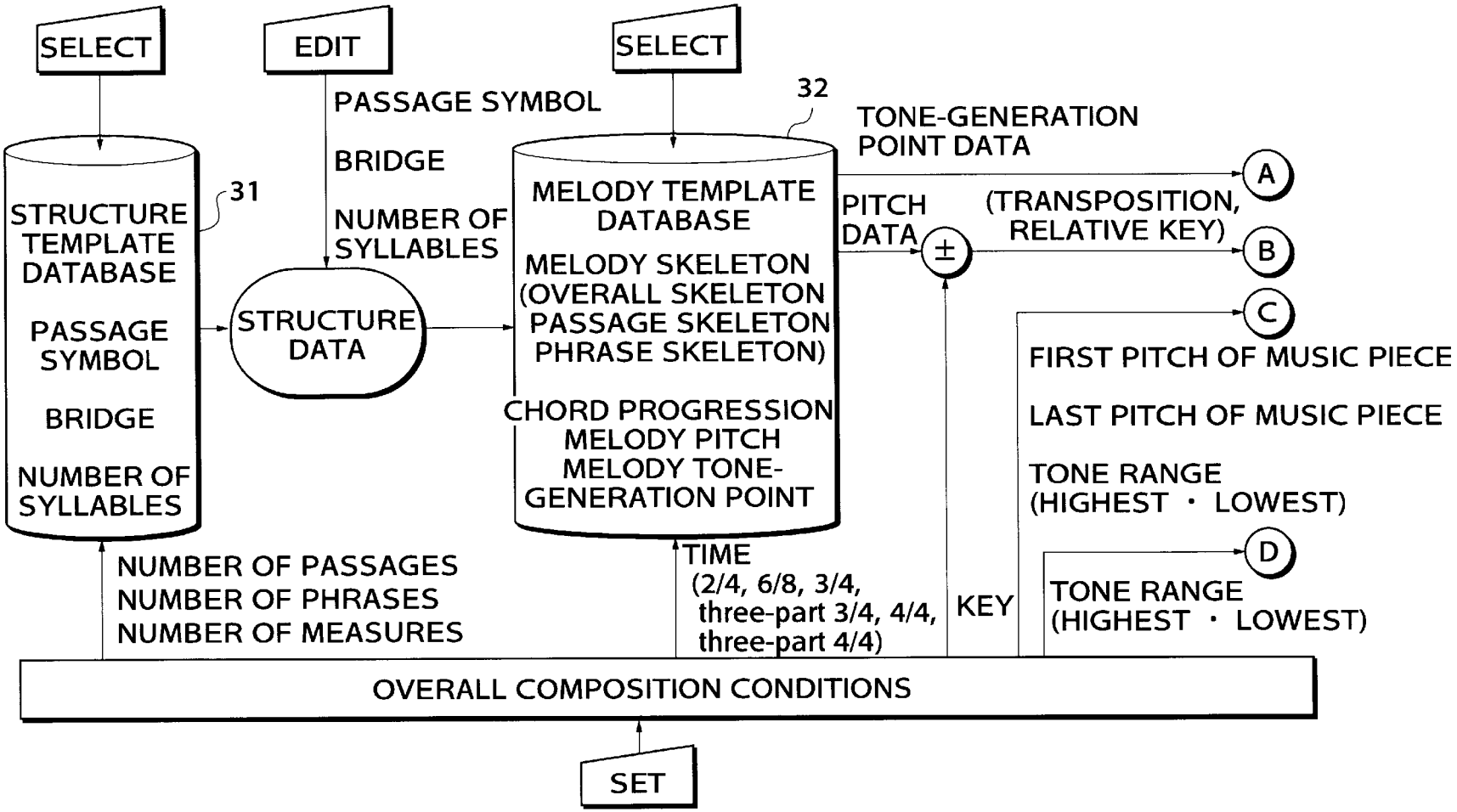
FIG. 2 is a view visually representing control operations performed by the automatic composition apparatus of FIG. 1.
Figure 3:
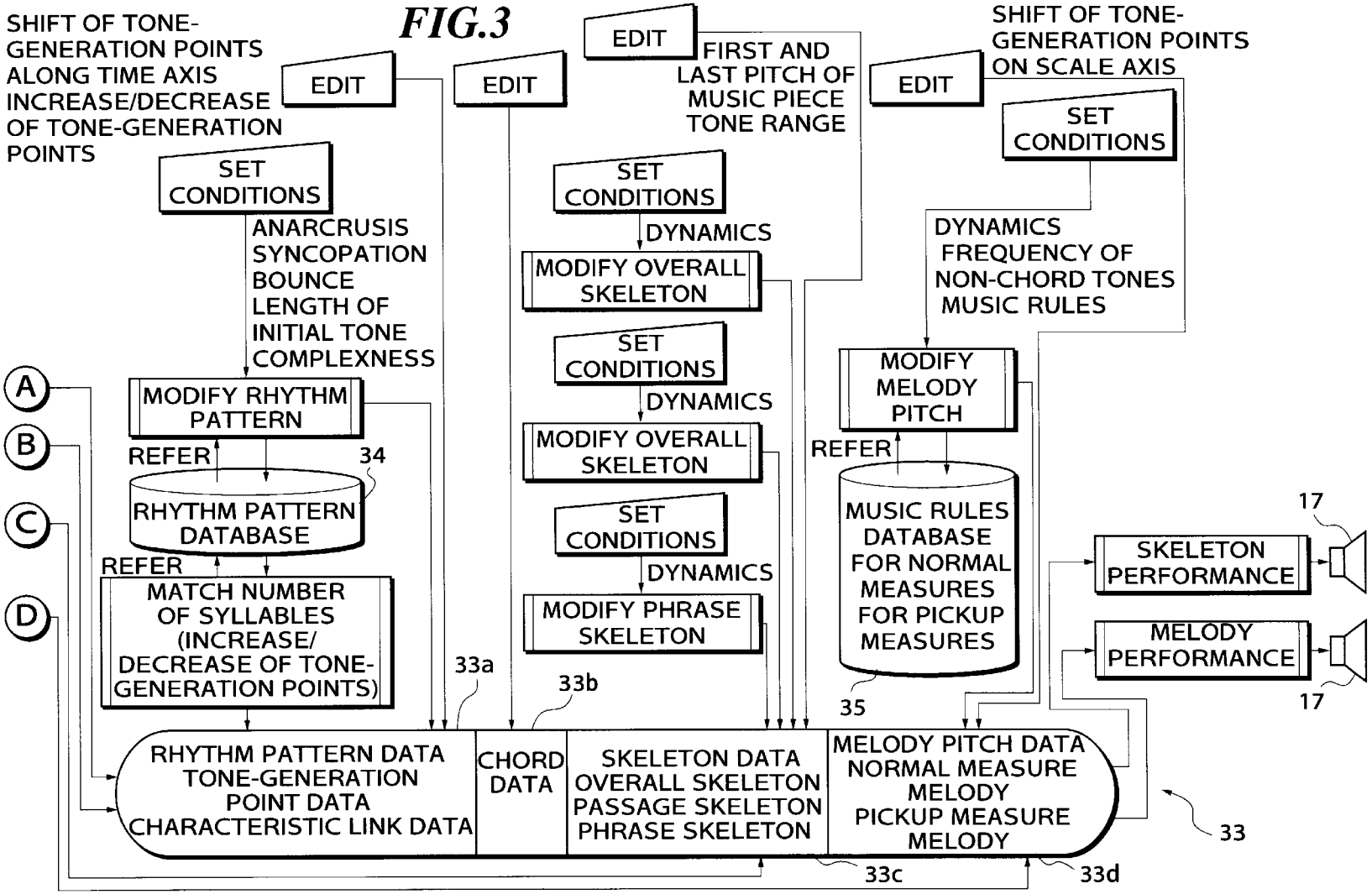
FIG. 3 is a view visually representing control operations performed by the automatic composition apparatus of FIG. 1.

FIG. 2 and FIG. 3 visually represent various control operations performed by the automatic composition apparatus of the present embodiment. Referring to FIGS. 2 and 3, the summary of the control operations will be described.

In FIG. 2, the user initially selects one from a plurality of templates each containing a set of overall composition conditions (the overall composition condition templates may be stored in the hard disc as described above), to thereby set (enter) a desired set of overall composition conditions contained in the selected template. Items to be set as the overall composition conditions include, for example, the number of passages, the number of phrases, time or meter, key, the first pitch of a piece of music, the last pitch of the music piece, the tone range (defined by the highest tone and the lowest tone), and so forth. Data corresponding to these items are prescribed in advance in each of the templates to which a certain name is given. If the user selects a mode for selecting the overall composition conditions, using the mouse as indicated above, and clicks a column of "overall composition conditions" displayed in this mode, a pop-up menu listing the names of the templates appears on the display. If the user selects a desired one of the template names, the overall composition conditions contained in the template corresponding to the selected name are established. It is, however, to be noted that the items of the composition conditions may be individually modified or entered by the user.

Based on the number of passages, the number of phrases and the number of measures, among the overall composition conditions established in the above manner, a structure template that best matches the above conditions is selected or retrieved from a structure template database 31, or a plurality of structure templates matching the above conditions are presented to the user, thus allowing the user to select one of these templates. Here, the structure template database 31 is a database constructed on the hard disc, and consists of a plurality of structure templates. Structure data contained in each structure template include, for example, a passage symbol (that will be described later referring to FIG. 10) set for each passage, the position of a bridge passage, the number of syllables, and so on. If the structure data of the structure template retrieved from the structure template database 31 is different from the one desired by the user, the user may select a desired one from other candidates, or edit a part of the structure data of the structure temperate thus retrieved.

A melody template database 32 is then searched based on the thus generated structure data (except the number of syllables) and the time or meter set as one of the overall composition conditions, and a melody template that best matches these conditions is retrieved from the database 32. The melody template database 32 may be constructed on the hard disc, like the structure template database 31, and consists of a plurality of melody templates. Each melody template contains data of each of items including a melody skeleton (that consists of an overall skeleton as the uppermost layer, a passage skeleton as the intermediate layer, and a phrase skeleton as the lowest layer, in the hierarchical structure of the present embodiment), chord progression, pitches, and tone-generation points of a melody. The data contained in each melody template is sufficient as it is (without being modified as described later) for performance of a piece of music. If a certain melody template is retrieved from the melody template database 32 as described above, each piece of data contained in the melody template is established (entered). If the selected melody template is different from the one desired by the user, a desired one may be selected from other candidates, as in the case of the structure template.

Once each data contained in the melody template has been entered, pitch data among the data entered is converted into that of a transposed key or relative key, according to the key that was set as one of the overall composition conditions, and the resulting pitch data is supplied to a melody template modifying unit 33 of FIG. 3. The data other than the pitch data are supplied to the melody template modifying unit 33 without being changed.

As shown in FIG. 3, the melody template modifying unit 33 consists of a rhythm pattern data modifying unit 33*a,* a chord data modifying unit 33*b,* a skeleton data modifying unit 33*c,* and a melody pitch data modifying unit 33*d.*

Where the rhythm pattern in the selected melody template is different from that desired or intended by the user, the rhythm pattern data modifying unit 33*a* generates a rhythm pattern characteristic link table and new tone-generation point data (rhythm pattern data), based on various conditions set by the user, including items such as the presence of anacrusis (unstressed note), the presence of syncopation, the presence of bounce (dotted note), the length of the initial note, and the level of complexness (easiness/difficulty). The rhythm pattern characteristic link table is constructed by setting data relating to each of the above items, namely, rhythm pattern characteristics, for each measure, and linking a series of the set data over the entire piece of music. The tone-generation point represents a point of time at which a tone of a melody is generated, and the number of tone-generating points in one measure corresponds to the number of syllables in the same measure. Based on each characteristic link data in the rhythm pattern characteristic link table, a rhythm pattern for one measure is retrieved from a rhythm pattern database 34. Then, rhythm pattern data of the whole piece of music is generated by linking or connecting the rhythm patterns of all of the measures in the piece of music in question.

Also, matching of the number of syllables is performed when the number of syllables set by the user is different from the number of the tone-generation points in the selected melody template (this situation occurs since the information on the number of syllables is not referred to for the retrieval of the melody template), or where the number of syllables set by the user is different from the number of tone-generation points in the rhythm pattern data of the whole piece of music generated as described above. For matching of the number of syllables, a rhythm pattern having the same characteristics as the rhythm pattern in the melody template to be replaced or the rhythm pattern generated as described above but having a different number of syllables is retrieved or selected from the rhythm database 34, so as to effect replacement of the rhythm pattern by the selected one with a result of an increase/decrease in the number of syllables.

The present apparatus is also provided with an edit function that enables the user to perform manual operations for shifting the time axis along which the tone-generation points are distributed, or increasing/decreasing the number of the tone-generation points. If the time axis of the tone-generation points is shifted or the number of these points is changed as a result of a manual operation, the rhythm pattern data modifying unit 33*a* modifies corresponding rhythm pattern data.

The chord data modifying unit 33*b* modifies chord data according to an edit command or instructions of the user, when the chord progression in the selected melody template is different from the one desired by the user.

The skeleton data modifying unit 33*c* performs individual modifying operations with respect to the respective layers of skeleton data contained in the selected melody template, and also performs the overall editing operation with respect to all layers of skeleton data.

The melody pitch data modifying unit 33*d* modifies melody pitch data of the selected melody template, based on dynamics set by the user, the frequency of non-chord tones, and musical rules, while referring to a musical rule database 35. If the user generates a command for a scale-axis shift of tone-generation points by a manual operation, the melody pitch data modifying unit 33*d* modifies melody pitch data according to the command. Since this modification is individually performed with respect to normal measures and pickup measures in the present embodiment, the musical rule database 35 consists of two types of databases for the normal measures and pickup measures, respectively.

In the manner as described above, the rhythm pattern data modifying unit 33*a* modifies rhythm pattern data, and the skeleton data modifying unit 33*c* modifies each skeleton data, i.e., overall skeleton data, passage skeleton data, and phrase skeleton data, while the melody pitch data modifying unit 33*d* modifies melody pitch data of normal measures and melody pitch data of pickup measures, independently of each other. As these modifying operations proceed, the results of the operations (the progress of composition) are displayed on the display device 9.

In addition to the function of reproducing and playing melody pitch data (musical tone data) generated as a result of modification by the melody pitch data modifying unit 33*d,* the automatic composition apparatus of the present embodiment has a function of reproducing and playing musical tone data of each of the three layers of skeleton data generated as a result of modification by the skeleton data modifying unit 33*c*. If the user designates a certain layer of skeleton data and enters a command for performance of this layer of skeleton data, therefore, pitch data (musical tone data) corresponding to the designated skeleton is read out from the skeleton data that has been modified by the skeleton data modifying unit 33*c* and reproduced, and then converted into sound by the sound system 17. If the user enters a command for melody performance, on the other hand, pitch data (musical data) corresponding to the desired melody is read out from the melody pitch data that has been modified as described above and reproduced, and then converted into sound by the sound system 17.

The present invention is characterized by the melody pitch data modifying operation, among the above-described three types of main operations, i.e., rhythm pattern data modifying operation, skeleton data modifying operation and melody pitch data modifying operation, which are performed by the melody template modifying unit 33. The melody pitch modifying operation will be briefly described first, and then described in greater detail with reference to FIG. 4 through FIG. 15.

The melody pitch data modifying operation is performed in the following manner.

1) In the case where a piece of music to be composed consists solely of normal measures, melody pitches are generated in the manner as described below:

a) The minimum generation unit is set to one measure, and melody pitches are generated based on a maximum of two node pitches given to the measure in question, composition conditions that have been set, and a rhythm pattern separately generated for the measure in question.

i) If the measure in question is contained in a same-name or similar passage, melody pitches of this measure are generated while maintaining similarity to its reference measure.

ii) If the measure in question is contained in a new passage, melody pitches of this measure are newly generated.

b) The melody pitches thus generated for one measure are evaluated in terms of musical requirements, and if they do not pass the musical evaluation or do not satisfy the musical requirements, the above-described operation a) is performed again. If the melody pitches pass the musical evaluation or satisfy the musical requirements, on the other hand, the next operation c) is performed.

c) The melody pitch generating operation a) for one measure is repeated with respect to one phrase, so as to generate melody pitches of the phrase in question.

d) The melody pitches thus generated for one phrase are evaluated in terms of musical requirements, and if they do not pass the musical evaluation or do not satisfy the musical requirements, the control flow returns to the above step a) and the operations of the steps a), b) and c) are performed again. If the melody pitches obtained as a result of the step c) pass the musical evaluation, the next operation e) is performed.

e) The melody pitch generating and evaluating operations c) and d) for one phrase are repeated with respect to all phrases in the piece of music, so as to generate melody pitches of the whole piece of music.

2) In the case where a piece of music to be composed includes pickup measures (if any tone or tones included in the next phrase is/are present in the latter part of a certain measure of the current phrase, the latter part of the measure is called "pickup measure" of the next phrase), melody pitches are generated in the following manner.

a) The above operations 1) a)–d) are performed with respect to normal measures, and the following operations are performed with respect to each pickup measure.

b) A pitch curve for the pickup measure in question is determined according to a rhythm pattern separately generated for the pickup measure in question, a pitch of the last tone-generation point of the phrase immediately before the current phrase, a pitch of the first tone-generation point of the measure located next to the pickup measure of the current phrase, and the number of syllables contained in the pickup measure in question.

c) The melody pitches of the pickup measure in question are generated along the pitch curve obtained in the above operation b);

d) The above operations b) and c) are performed individually with respect to all of the pickup measures in the piece of music.

e) The melody pitches of the whole piece of music are generated by linking the melody pitches of the normal measures generated in the operation a) with the melody pitches of all of the pickup measures generated in the operation d).

Figure 10:
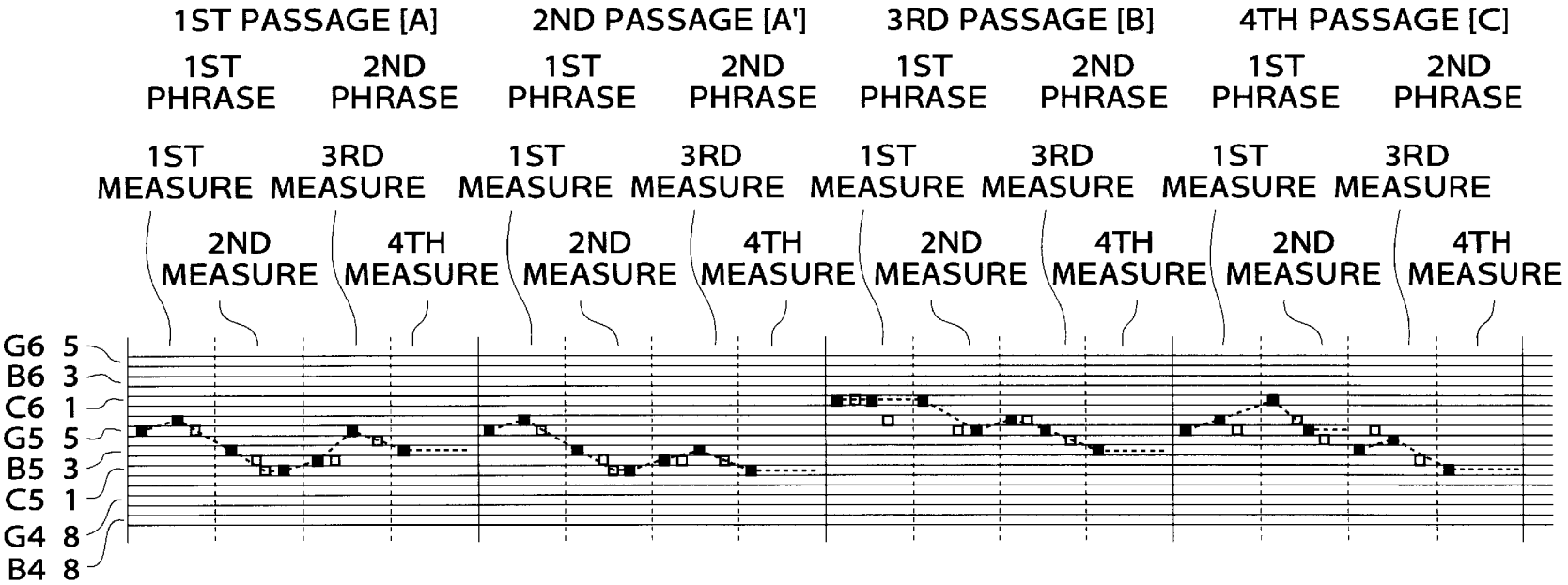
FIG. 10 is a view showing one example of melody pitches generated for normal measures.
Figure 11A:
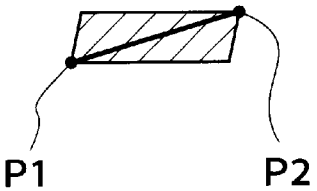
Figure 11B:
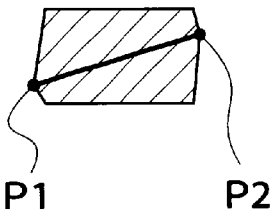
Figure 11C:
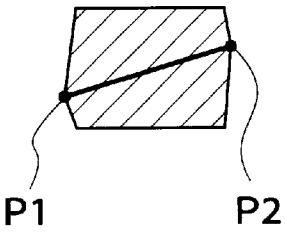
Figure 11D:
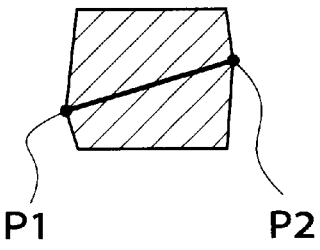

Here, "same-name passage" means a passage before which another passage having the same name of passage symbol as the passage in question exists, and "similar passage" means a passage before which another passage that is similar to the passage in question exists. In the present embodiment, there are two types of similar passages, i.e., "first type similar passage" and "second type similar passage". Also, "new passage" means a passage that is neither "same-name passage" nor "similar passage". Each passage in a piece of music is provided with a "passage symbol" that represents the relationship between passages. In FIG. 10, for example, "A", "A'", "B" nand "C" are passage symbols given to the first to fourth passages, respectively. In the example of FIG. 10, the first, third and fourth passages to which "A", "B" and "C" are set are "new passages", and the second passage to which "A'" is set is a "similar passage". No "same-name passage" is included in the example of FIG. 10. In addition, "reference measure" means a corresponding measure of a corresponding phrase of a reference passage that is present before the passage in question and is the same as or similar to this passage.

More specifically described, melody pitches of one measure are generated in the above operation 1) a), in the following manner.

1) Pitches other than node pitches are successively determined for each tone-generation point at a time, under moderate conditions, according to the minimum composition conditions (for example, the dynamics), musical rules and a pitch of a tone-generation point just before the tone-generation point in question.

2) The melody pitches of one measure thus generated are evaluated in terms of musical requirements that are a little more strict than the above conditions (namely, it is determined whether the melody pitches also satisfy such composition conditions and musical rules that are not included in the conditions under which the pitch of each tone-generation point was determined), and the generated melody pitches for one measure are adopted if they satisfy the musical requirements. If the melody pitches do not satisfy the musical requirements, on the other hand, the control flow returns to the initial operation 1) so as to re-generate melody pitches of the measure in question.

3) The melody pitches of one phrase are generated in the above-indicated operation 1) c), and the generated melody pitches are evaluated in terms of further strict musical requirements (namely, it is determined whether the melody pitches satisfy such composition conditions and music rules that were not used for evaluating the melody pitches of the measures):

a) Where the musical requirements are satisfied, the generated melody pitches for one phrase are actually used in the piece of music.

b) Where the musical requirements are not satisfied, i) pitches of the individual tone-generation points are modified if the resulting melody pitches are suppose to satisfy the musical requirements, or ii) if the musical requirements are not satisfied merely by modifying pitches of the individual tone-generation points, or extensive modification is needed, the control flow returns to the initial operation 1), so as to re-generate melody pitches for each measure of the phrase in question.

Next, a melody pitch data modifying routine will be described in detail.

Figure 4:
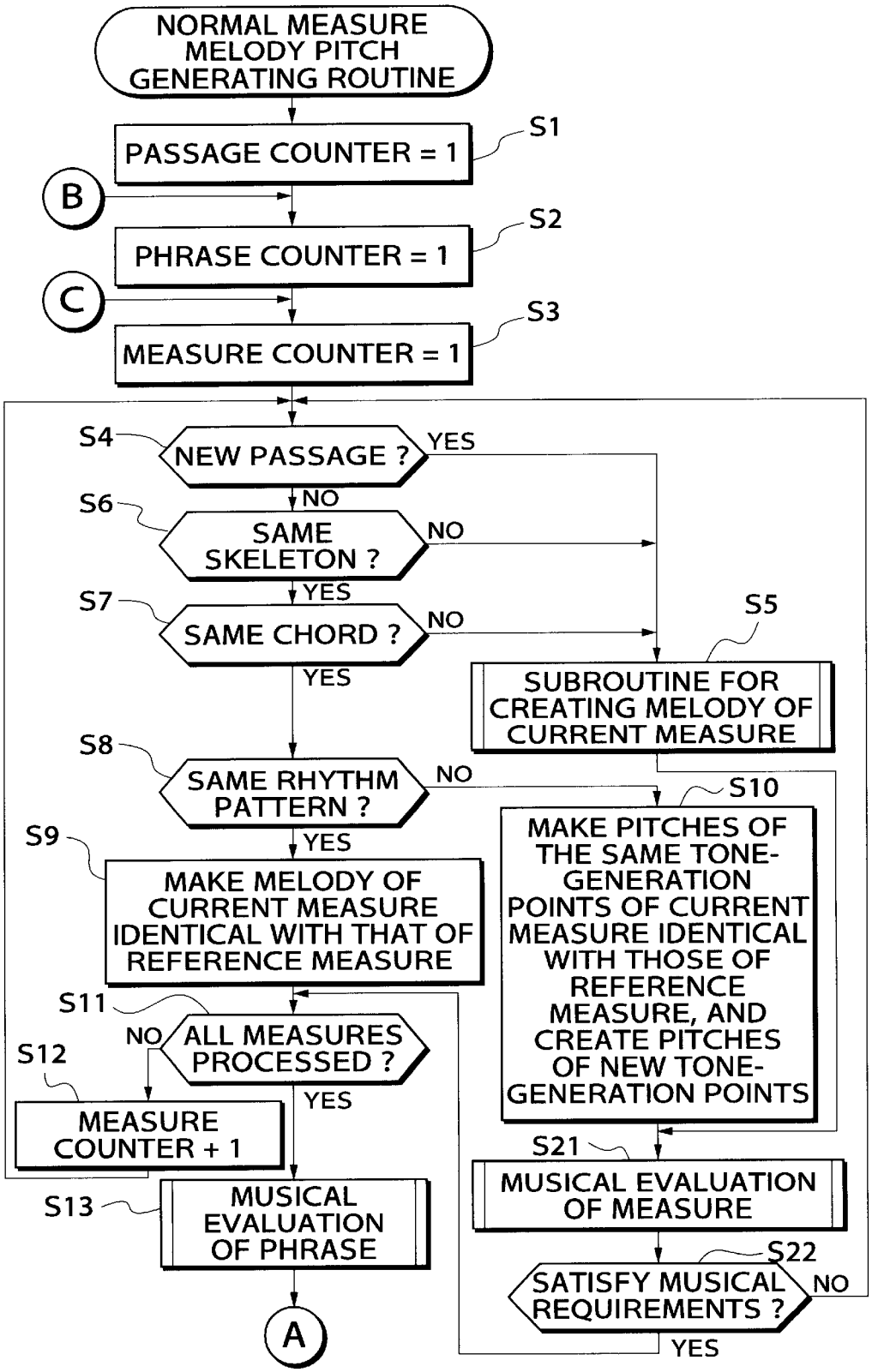
FIG. 4 is a flowchart showing a detailed flow of a normal measure melody pitch generating routine.

FIG. 4 is a flowchart showing a detailed flow of a normal measure melody pitch generating routine, which realizes the melody pitch modifying operation 1) as indicated above.

In step S1 of FIG. 4, a passage counter in the form of a soft counter provided in a certain region of the RAM 7 for counting the number of passage is initialized to "1".

In step S2, a phrase counter in the form of a soft counter provided in a certain region of the RAM 7 for counting the number of phrases is initialized to "1". Similarly, a measure counter in the form of a soft counter provided in a certain region of the RAM 7 for counting the number of measures is initialized to "1" in step S3.

Step S4 is then executed to determine whether the measure to be concerned in the current cycle is one of measures that constitute a new passage, and if it is included in a new passage, step S5 is executed to implement a subroutine for creating a melody of the measure in question. This subroutine consists of an operation of FIG. 6 (which will be described later) to allocate the nodes of a phrase skeleton to important tone-generation points, and an operation of FIG. 7 to generate pitches of tone-generation points between the important tone-generation points. After execution of step S5, the control flow goes to step S21. When the measure in question is not included in a new passage, namely, when the measure is within a same-name or similar passage, the control flow goes to step S6.

In step S6, it is determined whether the skeleton of the measure in question is identical with that of its reference measure or not. If these measures have the same skeleton, the control flow goes to step S7 to determine whether the chord of the measure in question is the same as that of the reference measure.

If step S7 determines that both of the above measures have the same chord, the control flow goes to step S8. If step S6 determines that both of the measures do not have the same skeleton, or step S7 determines that both of the measures do not have the same chord, the control flow goes to step S5, to execute the subroutine for creating a melody of the measure in question.

In step S8, it is determined whether both of the measure in question and the reference measure have the same rhythm pattern or not, and if they have the same rhythm pattern, step S9 is executed to determine the melody of the measure in question to be identical with that of the reference measure. If both of the measures do not have the same rhythm pattern, the pitches of the same tone-generating points of the present measure and the reference number are made equal to each other, and the pitches of new tone-generation points are newly created in step S10, and the control flow goes to step S21.

After the melody pitches of one measure are generated in step S5 or S10, step S21 is executed to implement a subroutine (one example of which will be described later referring to FIG. 9) for evaluating the melody pitches of one measure in terms of musical requirements. In the following step S22, it is determined whether the generated melody pitches of one measure satisfy the musical requirements of step S21 or pass the musical evaluation of step S21, and if they satisfy the requirements, the control flow goes to step S11. If the melody pitches do not satisfy the musical requirements, on the other hand, the control flow goes returns to step S4 to re-generate melody pitches of the measure in question.

Step S11 is then executed to determine whether the operations of steps S4–S10 have been performed on all of the measures. If any of the measures still remains, the measure counter is incremented by "1" in step S12, and the control flow returns to step S4 to repeat the above-described operations. If all of the measures have been processed, the control flow goes to step S13.

Figure 5:
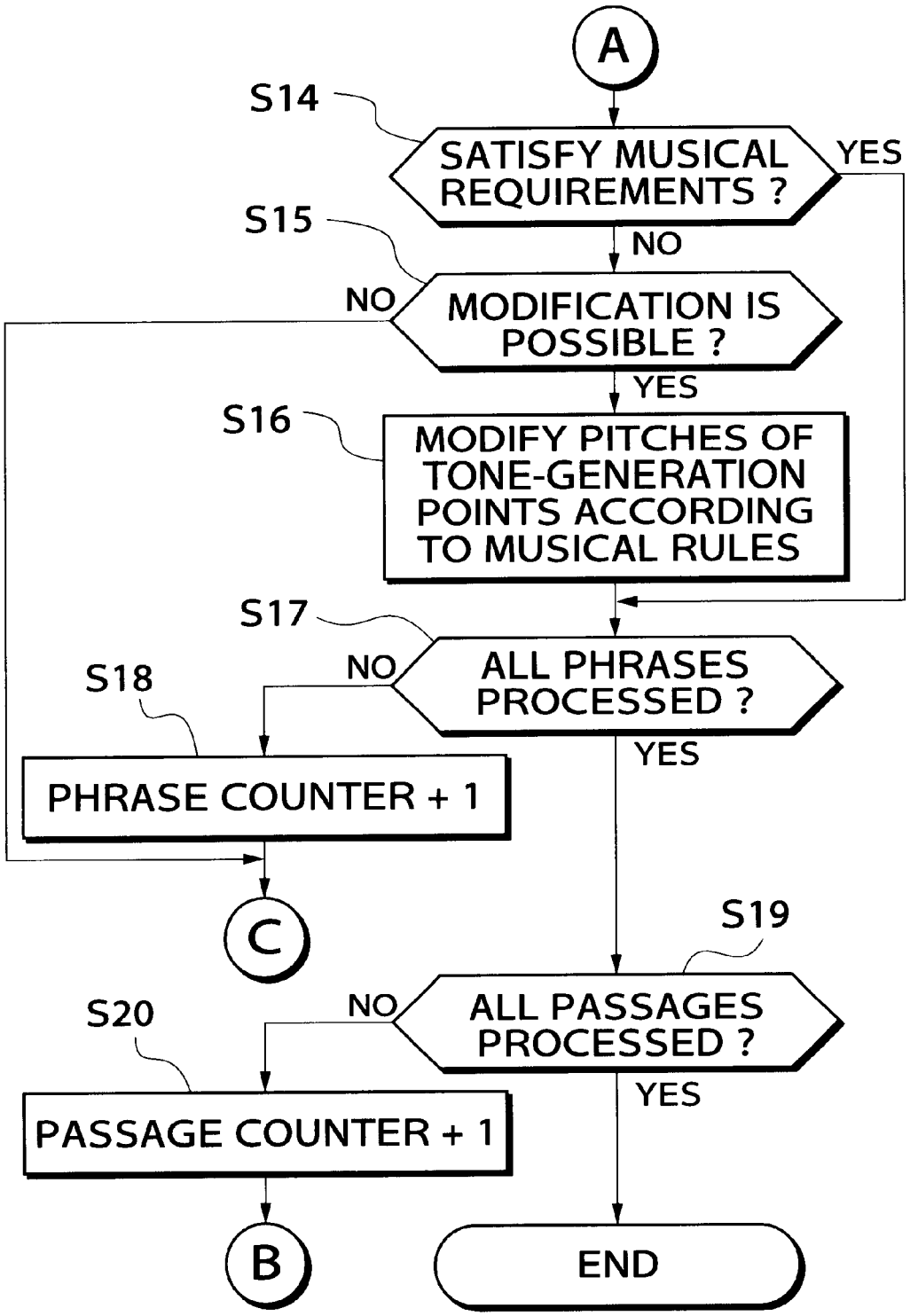
FIG. 5 is a flowchart showing a detailed flow of a remaining part of the normal measure melody pitch generating routine.

In step S13, a musical evaluation subroutine (one example of which will be described later referring to FIG. 8) for evaluating each phrase in terms of musical requirements is executed, and step S14 of FIG. 5 is then executed to determine if the musical requirements are satisfied or not.

If step S14 determines that the phrase to be concerned in the current cycle does not satisfy the musical requirements of step S13, step S15 is executed to determine if modification is possible or not. The determination as to whether modification is possible is made in the following manner:

If the number of measures to be modified so as to satisfy the musical requirements is equal to or larger than a predetermined value, or if the number of tone-generating points to be modified is equal to or larger than a predetermined value, it is determined that the modification is impossible. (In other words, the modification is possible if each number is smaller than the predetermined value.) Also, if any new disadvantage in a musical sense arises when a certain measure or a certain tone-generation point is modified so as to satisfy the musical requirements, it is determined that the modification is impossible. (In other words, the modification is possible if no musical disadvantage arises.) It is also possible to determine whether the modification is possible or not according to criteria other than those as described above.

If step S15 determines that the modification is possible, step S16 is executed to modify the pitch of each tone-generation point of the measure that needs to be modified, according to the musical rules. Step S17 is then executed to determine whether the operations of steps S3–S16 have been performed on all of the phrases in the current passage. If any of the phrases remains unprocessed, step S18 is executed to increment the phrase counter by "1", and the control flow returns to step S3 to repeat the above-described operations.

If step S14 determines that the phrase in question satisfies the musical requirements of step S13, the control flow goes to step Sl7 skipping steps S15 and S16. If step S15 determines that the modification is impossible, the control flow returns to step S3 to perform the melody pitch generating operation for all of the measures in the phrase in question again.

In the following step S19, it is determined whether the operations of steps S2–S18 have been performed on all of the passages in the piece of music. If any of the passages still remains unprocessed, the passage counter is incremented by "1" in step S20, and the control flow returns to step S2, to repeat the above-described operations. If all of the passages have been processed, the present routine for generating melody pitches of normal measures is finished.

Figure 6:
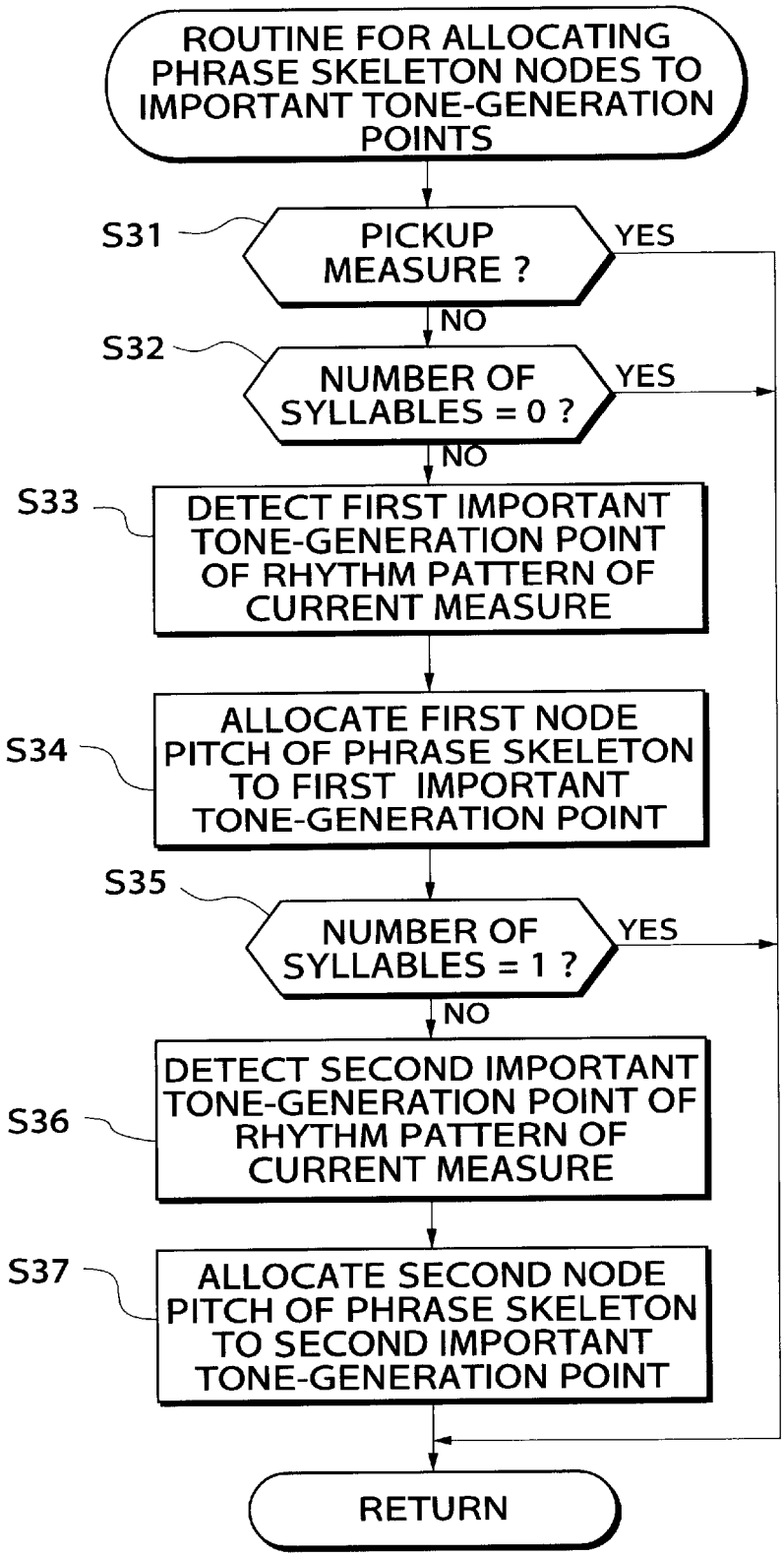
FIG. 6 is a flowchart showing a detailed flow of a routine for allocating phrase skeleton nodes to important tone-generation points, which provides a subroutine of FIG. 4 for creating a melody of the measure in question.

FIG. 6 is a flowchart showing a detailed flow of the subroutine of the above step S5 for creating a melody of the measure in question, wherein the phrase skeleton nodes are allocated to the important tone-generation points. Here, the phrase skeleton nodes are to be interpreted as nodes that form or constitute a phrase skeleton that has been generated as a result of modification by the skeleton data modifying unit 33*c*. In the present embodiment, a maximum of two nodes are present for each measure.

Before the routine for allocating the phrase skeleton nodes to the important tone-generation points is described in detail referring to the flowchart of FIG. 6, its algorithm will be first explained.

The present routine is constructed according to the following algorithm:

1) Allocation of the phrase skeleton nodes to the important tone-generation points is not conducted with respect to pickup measures, but conducted only with respect to normal measures.

2) Since two phrase skeleton nodes are generated for each measure in the present embodiment, two important tone-generation points (first and second important tone-generation points) are detected for each measure, and the generated phrase skeleton nodes are allocated to the respective important tone-generation points. If the number of syllables in the measure in question is "0", which means that no important tone-generation point is present in the measure, the present operation is not performed. If the number of syllables in the measure in question is "1", which means that only one important tone-generation point is present in the measure, one of the generated phrase skeleton nodes is allocated to the only one important tone-generation point.

The first important tone-generation point is detected as follows:

1) Priority 1: The first tone-generation point of the measure is detected as the first important tone-generation point in principle.

2) Priority 2: If the first tone-generation point of the measure has a short tone, and the second tone-generation point has a long tone, the second tone-generation point is detected as the first important tone-generation point.

The second important tone-generation point is detected as follows:

1) Priority 1: Where the measure in question is the last measure of the relevant phrase, the last tone-generation point of this measure is detected as the second important tone-generation point.

2) Priority 2: The tone-generation point at the third beat is detected as the second important tone-generation point.

3) Priority 3: The tone-generation point just before or after the tone-generation point at the third beat is detected as the second important tone-generation point.

4) Priority 4: The tone-generation point to which a long tone is allocated is detected as the second important tone-generation point.

The routine for allocating the phrase skeleton nodes to the important tone-generating points will be described with reference to the flowchart of FIG. 6.

In FIG. 6, step S31 is initially executed to determine whether the measure to be concerned in the current cycle is a pickup measure or not. If it is not a pickup measure, namely, if it is a normal measure, step S32 is then executed to determine whether the number of syllables in this measure is equal to "0".

If step S32 determines that the number of syllables in the measure in question is not equal to "0", step S33 is executed to detect the first important tone-generation point of the rhythm pattern of this measure according to the order of priority as described above, and step S34 is then executed to allocate the first node pitch of the phrase skeleton to the first important tone-generation point.

If the above step S31 determines that the measure in question is a pickup measure, or step S32 determines that the number of syllables in the measure is equal to "0", the present routine is finished.

In step S35, it is determined whether the number of syllables in the measure in question is equal to "1" or not. If the number of syllables in this measure is equal to "1", the present routine is finished. If the number of syllables in the measure is not equal to "1", on the other hand, step S36 is executed to detect the second important tone-generation point of the rhythm pattern of the measure in question according to the order of priority as described above, and step S37 is then executed to allocate the second node pitch of the phrase skeleton to the second important tone-generation point. After execution of step S37, the present routine is finished.

FIG. 10 shows one example of melody pitches generated with respect to normal measures, wherein two types of squares, i.e., black squares and white squares, are used. The black squares represent tone-generation points detected as the important tone-generation points within each measure, to which the node pitches of the phrase skeleton are allocated in the manner as described above. The white squares represent tone-generation points at which pitches are generated by a process as described below for generating pitches of tone-generation points between the important tone-generation points.

Thus, the node pitches of the phrase skeleton are determined as pitches of the important tone-generation points, so that the phrase skeleton can be reflected in the melody thus generated.

FIG. 7 is a flowchart showing a detailed flow of a routine for generating pitches of tone-generation points between the important tone-generation points, which provides the subroutine of the above step S5 for creating a melody of the measure in question. Before describing the present routine referring to the flowchart of FIG. 7, its algorithm will be described.

The present routine is constructed according to the following algorithm:

1) Generation of pitches of tone-generation points between the important tone-generation points is carried out only with respect to normal measures, but not to pickup measures.

2) A pitch is generated for each of tone-generation points (other than important tone-generation points) to which no pitch has been given, within an interval defined between the important tone-generation points.

3) The above operation 2) is performed with respect to all intervals included in the measure in question.

More specifically, the above operation 2) is performed in the following manner:

1) The first node pitch and the last node pitch of the interval in question are obtained.

2) The highest tone limit and lowest tone limit of the interval are determined based on the first and last node pitches obtained in the above operation 1) and the dynamics set in advance.

3) A pitch selected at random between the highest tone limit and the lowest tone limit is assigned to each of the tone-generation points for which no pitch has been generated, and this operation is successively performed for all of these tone-generation points in the interval in question.

Next, the routine for generating pitches of tone-generation points between the important tone-generation points will be described based on the flowchart of FIG. 7.

In FIG. 7, step S41 is initially executed to determine whether the measure in question is a pickup measure or not. If it is a pickup measure, the present routine is terminated. If it is not a pickup measure but a normal measure, the control flow goes to step S42.

In step S42, it is determined whether the number of syllables in the measure in question is equal to "0". If the number of syllables in the measure is equal to 0, the present routine is finished. If the number of syllables in the measure is not equal to 0, the control flow goes to step S43.

In step S43, an interval counter in the form of a soft counter provided in a certain region of the RAM 7 for counting the number of intervals is initialized to "1". Step S44 is then executed to obtain the first node pitch and the last node pitch of the interval in question.

In step S45, the highest tone limit and lowest tone limit of the interval are determined based on the thus obtained first and last node pitches of the interval, and the set dynamics.

FIGS. 11A to 11D is a views useful in explaining the operation of determining the highest and lowest tone limits of the interval in question. The highest and lowest tone limits of the interval that is defined between the first node pitch pl and the last node pitch p2 are determined according to the value of the set dynamics, as indicated by hatched regions in FIGS. 11A to 11D.

(a) Dynamics=0: The lowest tone limit is set to the lower one of the first node pitch and the last node pitch (the first node pitch p1 in FIG. 11A), and the highest tone limit is set to the other of the first and last node pitches (the last node pitch p2 in FIG. 11A).

(b) Dynamics=1: The lowest tone limit is set to a pitch that is one degree, for example, lower than the lower one of the first node pitch and the last node pitch (the first node pitch in FIG. 11B), and the highest tone limit is set to a pitch that is one degree, for example, higher than the other of the first and last node pitches (the last node pitch in FIG. 11B).

(c) Dynamics=3: The lowest tone limit is set to a pitch that is three degrees, for example, lower than the lower one of the first node pitch or the last node pitch (the first node pitch in FIG. 11C), and the highest tone limit is set to a pitch that is three degrees, for example, higher than the other of the first and last node pitches (the last node pitch in FIG. 11C).

(d) Dynamics=5: The lowest tone limit is set to a pitch that is five degrees, for example, lower than the lower one of the first node pitch or the last node pitch (the first node pitch in FIG. 11D), and the highest tone limit is set to a pitch that is five degrees, for example, higher than the other of the first and last node pitches (the last node pitch in FIG. 11D).

Returning to the routine of FIG. 7, a tone-generation point counter in the form of a soft counter provided in a certain region of the RAM 7 for counting the number of tone-generation points in the interval in question is initialized to "1" in step S46.

In the next step S47, the pitch of the current tone-generation point is determined at random within a tone range between the highest tone limit and the lowest tone limit of the interval. It is to be noted, however, that the pitch of the tone-generation point is determined at random only under the following conditions:

(a) Dynamics=0: The pitch of the current tone-generation point is determined at random so that a pitch difference between the current tone-generation point and the tone-generation point immediately before the current one is held within the range of ±3.

(b) Dynamics=1: The pitch of the current tone-generation point is determined at random so that a pitch difference between the current tone-generation point and the tone-generation point immediately before the current one is held within the range of ±4.

(c) Dynamics=2: The pitch of the current tone-generation point is determined at random so that a pitch difference between the current tone-generation point and the tone-generation point immediately before the current one is held within the range of ±4.

(d) Dynamics=3: The pitch of the tone-generation point in question is determined at random so that a pitch difference between the current tone-generation point and the tone-generation point immediately before the current one is held within the range of ±8.

In the following step S48, it is determined whether the operation of step S47 has been finished with respect to all of the tone-generation points in the interval that is being processed. If any of the tone-generation points still remains unprocessed, step S49 is executed to increment the tone-generation counter only by "1", and the control flow returns to step S47 to repeat the above-described operation. If the operation has been performed on all of the tone-generation points, the control flow goes to step S50.

In step S50, it is determined whether the operations of steps S44–S49 have been performed on all of the intervals. If any of the intervals still remains unprocessed, step S51 is executed to increment the interval counter by "1", and the control flow returns to step S44 to repeat the above-described operations. If the operations have been performed on all of the intervals, the present routine is finished.

The musical evaluation will be now explained which is conducted in the subroutine of the above step S13 for evaluating each phrase in terms of musical requirements. The following are some examples of items to be checked in the musical evaluation. Namely, it is determined 1) whether the fourth note (avoid note) of a major I chord or minor III chord is inhibited except one in conjunct motion;

2) whether the flow of a melody generated brings about a sense of ending upon motion from a V7 chord to a I chord in the last part of the phrase;

3) whether a skip from a non-chord tone by three degrees or more is restricted;

4) whether the motion of 5th→7th→1st or 1st→7th→5th in a major chord is inhibited;

5) whether successive skips of three or larger degrees are those of chord tones;

6) whether skips of five or larger degrees at three tone-generation points result in chord tones at the latter two tone-generation points; and 7) whether the 6th node of a dorian scale is inhibited except one in conjunct motion.

Figure 8:
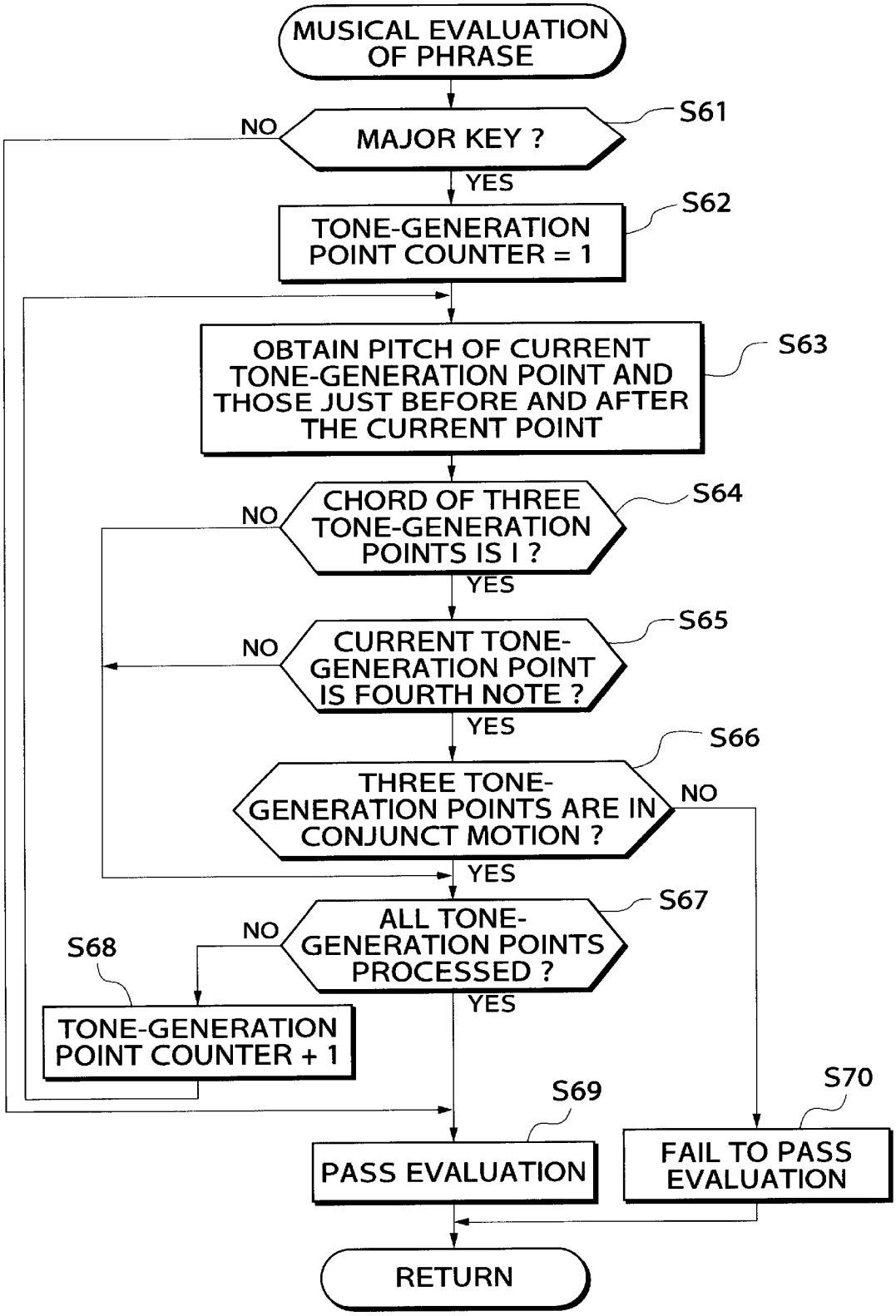
FIG. 8 is a flowchart showing a detailed flow of a subroutine of FIG. 4 for evaluating a phrase in terms of musical requirements.

FIG. 8 is a flowchart showing a detailed flow of the subroutine for evaluating each phrase in terms of musical requirements, more specifically, based on the item 1) as described above.

In FIG. 8, step S61 is initially executed to determine whether a key of the current phrase is a major key or not. If it is not a major key, the present routine is terminated. If it is a major key, on the other hand, the control flow goes to step S62.

In step S62, the tone-generation point counter is initialized to "1", and step S63 is then executed to obtain each pitch of a tone-generation point just before the current tone-generation point, the current tone-generation point, and a tone-generation point just after the current one.

Step S64 is then executed to determine whether the chord of the three tone-generation points obtained in step S63 is "I". If the chord is "I", step S65 is executed to determine whether the pitch of the current tone-generation point is the fourth note.

If step S65 determines that the pitch of the current tone-generation point is the fourth note, step S66 is executed to determine whether the above-indicated three tone-generation points occur in conjunct motion. If step S66 determines that they occur in conjunct motion, step S67 is executed to determine whether the operations of the above steps S63–S66 have been performed on all of the tone-generation points of the phrase. If any tone-generation point remains unprocessed, step S68 is executed to increment the tone-generation counter by "1", and the control flow returns to step S63 to repeat the above-described operations. If the above operations have been performed on all of the tone-generation points, the phrase in question is judged as passing the evaluation in step S69, and the present routine is finished.

If step S64 determines that the chord of the three tone-generation points is not "I", or step S65 determines that the pitch of the current tone-generation point is not the fourth note, the control flow goes to step S67 skipping step S66.

If step S66 determines that the three tone-generation points do not occur in conjunct motion, the phrase in question does not pass the evaluation in step S70, and the present routine is finished.

An example of musical evaluation will be explained which is conducted in the subroutine of the above step S21 for evaluating each measure in terms of musical requirements. Here, each measure is evaluated in terms of musical requirements that are only concerned with the current measure, but not related to preceding and following measures. The items of the evaluation include, for example, the frequency of non-chord tones contained in the current measure, and the range (width between the lowest tone and the highest tone) of tones contained in the measure.

Figure 9:
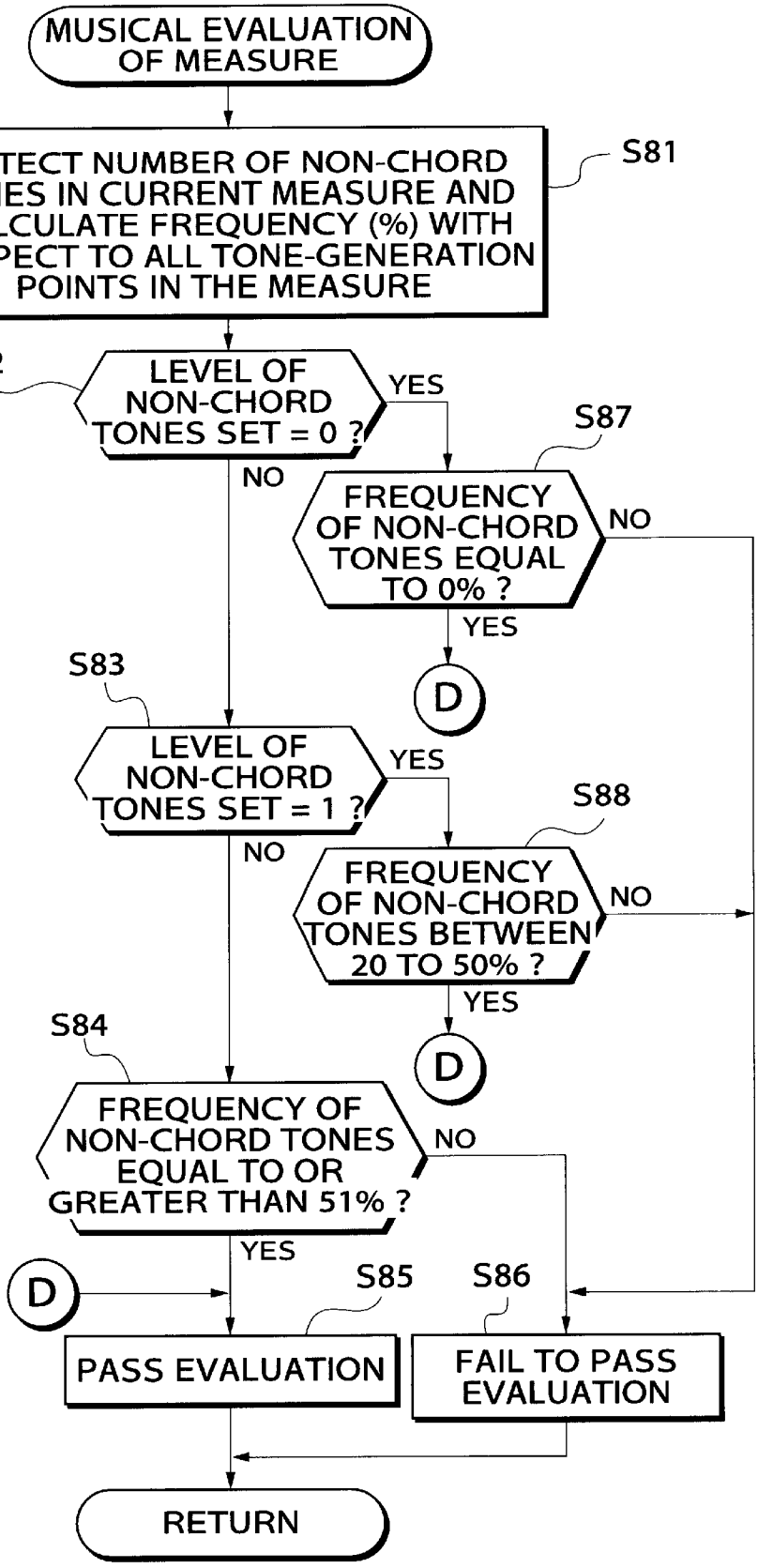
FIG. 9 is a flowchart showing a detailed flow of a subroutine of FIG. 4 for evaluating a measure in terms of musical requirements.

FIG. 9 is a flowchart showing a detailed flow of the subroutine for musically evaluating each measure based on the set level of the frequency of non-chord tones (refer to FIG. 3).

In FIG. 9, the number of non-chord tones in the current measure is detected, and the frequency (%) of non-chord tones relative to all tone-generation points in this measure is calculated in step S81.

Step S82 is then executed to determine the set level of non-chord tones, and the control flow proceeds as follows:

1) Set level of non-chord tones=0; step S82→step S87

2) Set level of non-chord tones=1; step S82→step S83→step S88

3) Set level of non-chord tones=2; step S82→step S83→step S84

In step S87, it is determined whether the frequency of non-chord tones is 0% or not, and, if the frequency is equal to 0%, the measure in question is judged as passing the evaluation in step S85. If the frequency is not equal to 0%, the measure is judged as not passing the evaluation in step S86.

In step S88, it is determined whether the frequency of non-chord tones is in the range of 20 to 50%, and, if the frequency is in the range of 20 to 50%, the measure in question is judged as passing the evaluation in step S85. If the frequency is less than 20% or greater than 50%, the measure is judged as not passing the evaluation in step S86.

In step S84, it is determined whether the frequency of non-chord tones is equal to or greater than 51%, and, if the frequency is equal to or greater than 51%, the measure in question is judged as passing the evaluation in step S85. If the frequency is less than 51%, the measure in question is judged as not passing the evaluation in step S86.

Figure 12:
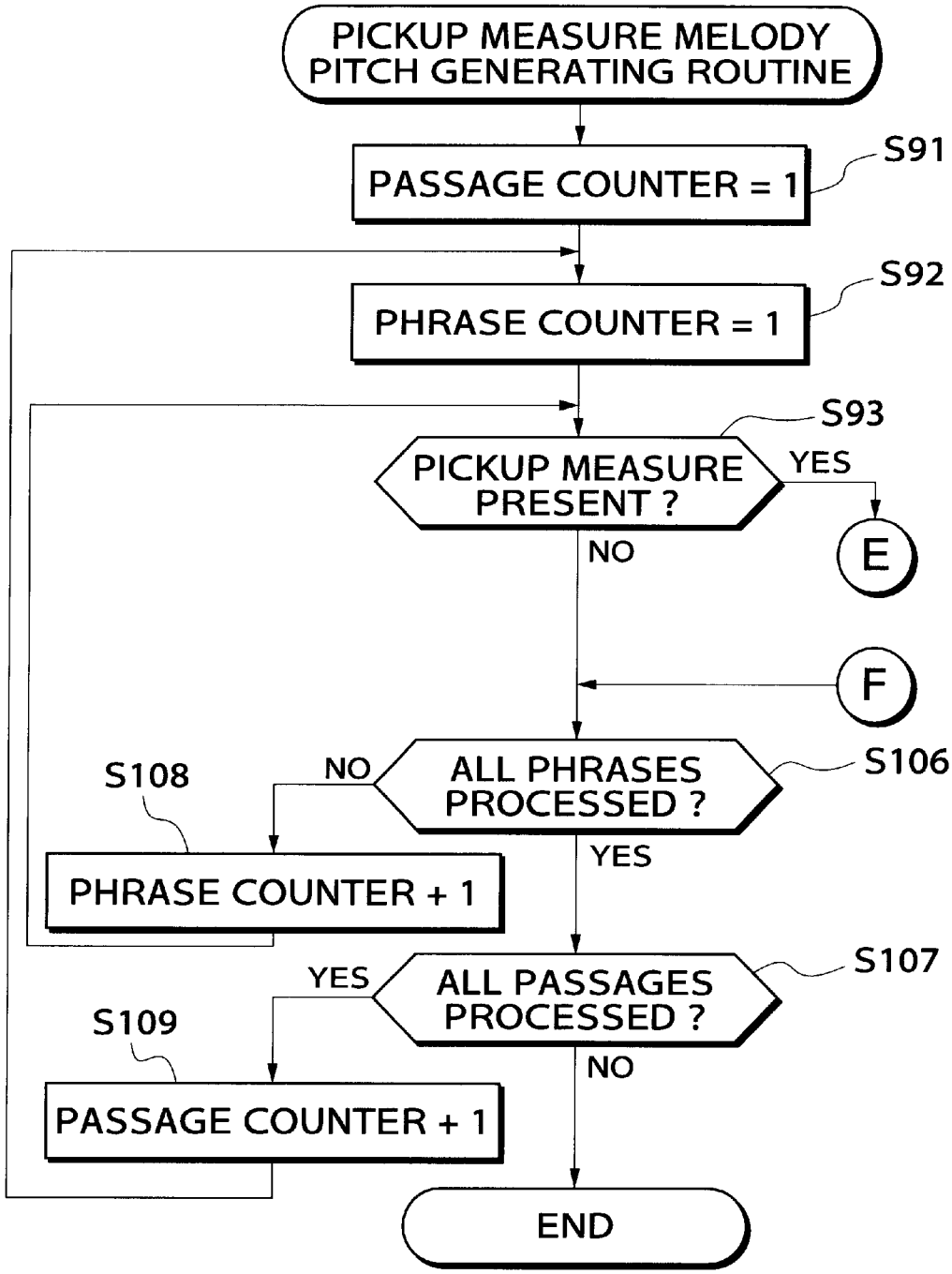
FIG. 12 is a flowchart showing a detailed flow of a remaining part of a pickup measure melody pitch generating routine.
Figure 13:
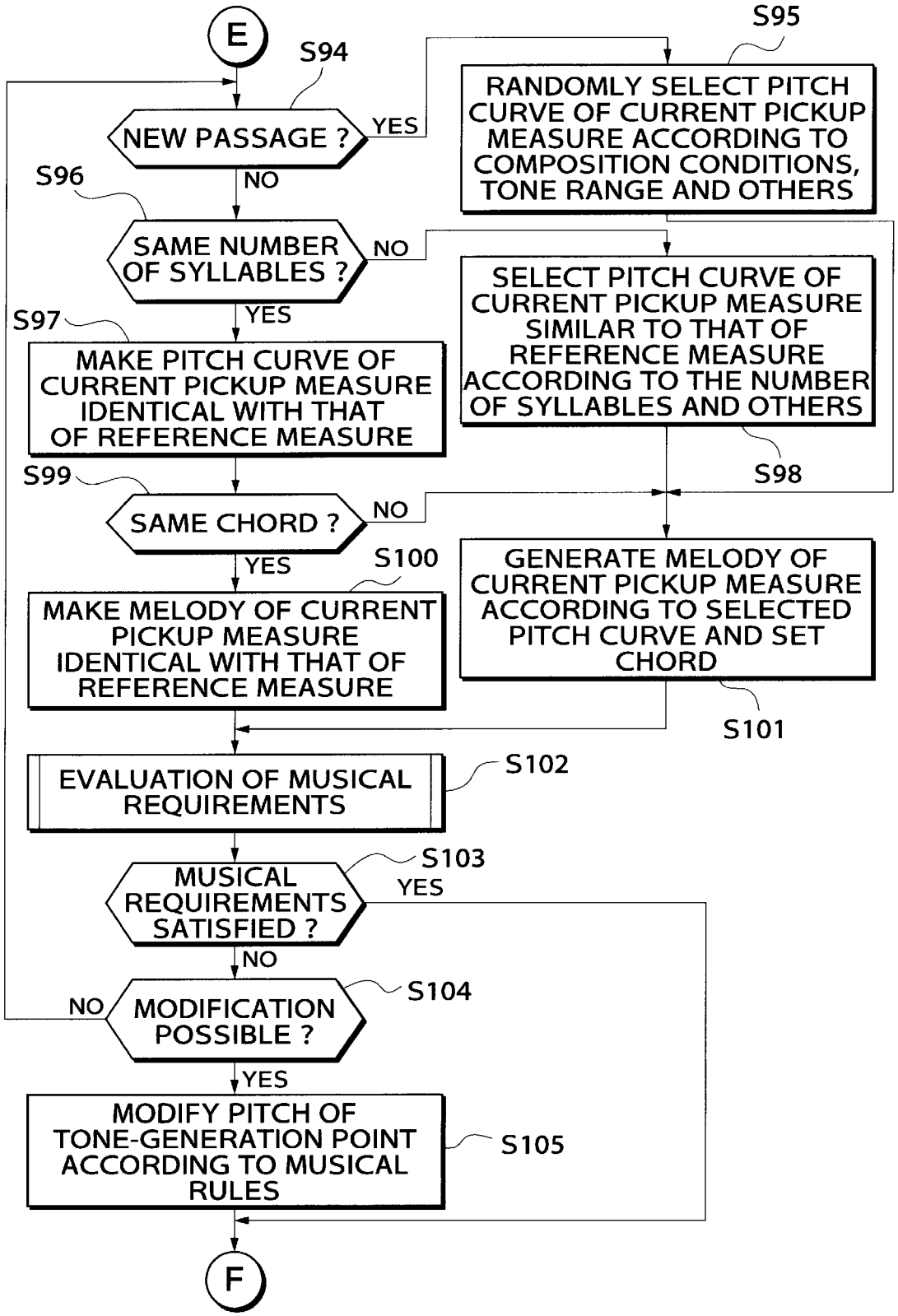
FIG. 13 is a flowchart showing a detailed flow of a remaining part of the pickup measure melody pitch generating routine.

FIG. 12 is a flowchart showing a detailed flow of a routine for generating melody pitches of pickup measures, which routine realizes the above-described melody pitch modifying operations 2) b)–d).

In FIG. 12, step S91 is first executed to initialize the passage counter to "1" as in step S1. Step S92 is then executed to initialize the phrase counter to "1" as in step S2.

Step S93 is then executed to determine whether any pickup measure is present in the phrase to be concerned in the current cycle. If no pickup measure is present, the control flow goes to step S106, and the same operations as in the above steps S17–S20 are performed in steps S106–S109. If any pickup measure is present, the control flow goes to step S94 of FIG. 13.

In step S94, it is determined whether the passage in question is a new passage. If it is a new passage, a pitch curve of the pickup measure is selected at random in step S95, according to the composition conditions, tone range and others, and the control flow then goes to step S101 in which a melody of the pickup measure is generated according to the selected pitch curve and the set chord.

FIG. 14 shows various types of pitch curves from which an appropriate one is selected. These types of pitch curves are registered in advance in the musical rule database 35 of FIG. 3.

In the operation of the above step S95, one pitch curve is selected at random from a plurality of candidates that are selected from the plural types of pitch curves of FIG. 14 according to the composition conditions, tone range, and others. For example, when "upward motion" and "conjunct motion to the first tone of the phrase" are set as the motion pattern (one example of composition conditions) from the last tone of the previous phrase to the first tone of the current phrase, the pitch curve of pattern number 010 in the row of "conjunct upward motion", and the pitch curve of pattern number 030 of "arpeggic upward motion" are selected as candidates, and one of these pitch curves is selected at random, to be determined as the pitch curve of the measure in question.

Returning to FIG. 13, if step S94 determines that the passage in question is not a new passage, namely, if it is a same-name or similar passage, step S96 is executed to determine whether the number of syllables in the pickup measure is equal to that of its reference measure. If the number of syllables is the same, the pitch curve of the pickup measure is made identical with that of the reference measure in step S97, and the control flow goes to step S99. If the number of syllables is different between the pickup measure and the reference measure, a pitch curve similar to that of the reference measure is selected according to the number of syllables and others, and the selected pitch curve is determined as the pitch curve of the pickup measure in step S98. After execution of step S98, the control flow goes to step S101.

In step S99, it is determined whether the current pickup measure and the reference measure have the same chord. If they have the same chord, the melody of the pickup measure is made identical with that of the reference measure in step S100. If the pickup measure and the reference measure have different chords, the control flow goes to step S101 in which the melody of the pickup measure is generated according to the selected pitch curve and the set chord.

In the following step S102, musical evaluation is conducted in a similar manner as in step S13, to determine in step S103 whether the current phrase satisfies the musical requirements set forth in step S102.

The operations of step S103 and subsequent steps are substantially the same as steps 14 and subsequent steps as described above, and thus will not be explained.

In the present embodiment, after the melody pitches of the whole phrase are generated under moderate first melody generation conditions, i.e., the set dynamics, the number of syllables, and others, (in particular, the operation of step S5 for creating a melody of the current measure is performed), the melody pitches thus generated are evaluated in terms of more strict second melody generation conditions, i.e., various musical rules, (in particular, the operation of step S13 for evaluating each phrase in terms of musical requirements is performed). With regard to a certain pitch, therefore, it can be determined whether the pitch satisfies musical requirements in view of not only the previous pitch but also the next pitch, thus making it possible to compose a piece of music that as a whole is favorable in a musical sense. Further, since the melody generated in the first stage only includes pitches that meet less strict melody generation conditions, this melody is less likely to be rejected in the evaluation of the second step, assuring high efficiency with which melody generation can be accomplished.

While a melody that passes musical evaluation under strict melody generation conditions is adopted or actually used in the piece of music, a melody that does not pass the evaluation may be modified, if possible, and then adopted in the music piece. Namely, the control flow returns to the previous step for re-generating melody pitches only if the already generated melody pitches cannot be modified. Thus, the melody that did not pass the evaluation has a possibility of passing the evaluation after suitable modifications thereof, thus assuring high efficiency with which melody generation is accomplished.

In addition, the melody pitches of the normal measures and the melody pitches of the pickup measures are generated independently of each other, and therefore a wide variety of melodies of pickup measures that satisfy musical requirements can be generated.

Figure 15:
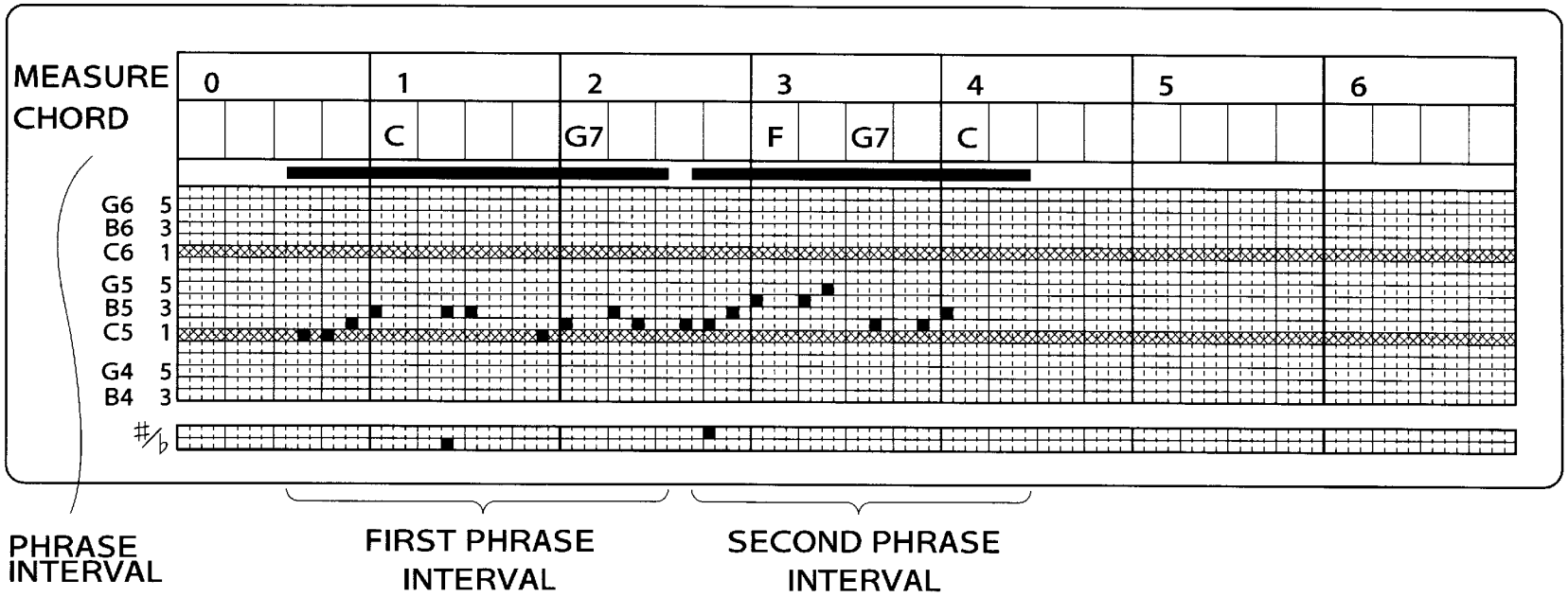
FIG. 15 is an example of melody pitches displayed on a display device appearing in FIG. 1.

FIG. 15 shows one example of melody pitches displayed on the display device 9, wherein melody pitches generated in the above-described manner are indicated on a piano roll score.

A general piano roll score indicates one octave consisting of twelve tones including chromatic semitones. In the score of the present embodiment shown in FIG. 15, however, one octave consists of seven tones that are scale tones of a certain key, and a separate section consisting of two rows is provided in which sharps or flats (#/♭) may be selectively indicated (the upper row corresponds to sharp (#), and the lower row corresponds to flat (♭)), thus saving display space, while making it easy for the user to take a general view of a melody line of the displayed melody. Depending upon the presence of # or ♭, in particular, the user is able to determine at a glance whether a certain pitch of the melody is a scale tone of the key or not. Also, the interval or length of each phrase is represented by a black bar that may extend over a plurality of measures, thus making it further easier for the user to take a view of the melody line in terms of phrases. With this arrangement, when a piece of music includes a pickup measure(s) (measure "0", in the example of FIG. 15), in particular, the user is able to easily recognize the beginning and end of the phrase. While the bars representing the phrase intervals are displayed in black in FIG. 15, due to restrictions on the drawing, such bars may be displayed in any color.

While the labels affixed to the left of the vertical axis of the score in FIG. 15 indicate tone pitches, such as "C5" and "B5", they may indicate syllable names (solfa), i.e., do, re, mi, fa, sol, la, ti, and do. In this case, if the pitches are indicated by solmization with the indication remaining unchanged even if the key is changed, the indication is easily understandable in any key. If a change in the key occurs in the course of a piece of music (modulation), and a plurality of keys are present on one display screen, the labels to the vertical axis may be displayed at the position where the key changes, as well.

The melody pitches generated in the above manner may be edited on the piano roll score. For example, the position or pitch of a certain tone-generation point may be modified by designating the point and dragging a mouse, or by clicking the point with the mouse. It is also possible to add or delete # or ♭ by clicking a corresponding position with the mouse.

In the illustrated embodiment, melody skeleton data stored in a template is modified as needed, and pitches of the melody skeleton data are then allocated to important tone-generation points. The present invention, however, is not limited to this process. For example, melody skeleton data may be generated according to certain algorithms, and modified as needed, and then pitches of the melody skeleton may be allocated to important tone-generation points. The modification of the melody skeleton data may be carried out according to a suitable algorithm, or through manipulations of the user (for example, by dragging a mouse over a display screen on which the melody skeleton data is displayed).

While melody pitch data are generated based on melody skeleton data having a hierarchical structure consisting of an overall skeleton, a passage skeleton, and a phrase skeleton, in the illustrated embodiment, melody pitch data may be generated based on melody skeleton data having no hierarchical structure, for example, the one having only phrase skeleton data for one piece of music.

An automatic composition apparatus according to another embodiment of the present invention will be now described.

In the previous embodiment, where the pitch difference (interval) between the first node pitch and the last node pitch is small (in the extreme case, the difference is "0") when pitches of tone-generation points between the important tone-generation points are generated, the width between the highest tone limit and the lowest tone limit in the current interval is set to a small value or degree. As a result, the differences between the generated pitches of the tone-generation points become too small, resulting in a monotonous melody. If the width between the highest tone limit and the lowest tone limit in the current interval is simply increased in view of the above situation, the width between the highest tone limit and the lowest tone limit becomes excessively large where the pitch difference between the first and last node pitches is large. The present embodiment has been developed to solve this problem.

The automatic composition apparatus of the present embodiment is different from that of the previous embodiment in a part of the routine (FIG. 7) for generating pitches of tone-generation points between the important tone-generation points, more specifically, in the method of determining the highest tone limit and the lowest tone limit in the current interval in step S45. In the previous embodiment, the highest and lowest tone limits of the interval in question are determined according to the first and last node pitches of the interval and the dynamics, as described above. In the present embodiment, on the other hand, the highest and lowest tone limits of the interval in question are determined according to the pitch difference (interval) between the first node pitch and the last node pitch, as well as the values of the first and last node pitches and the dynamics.

Figure 16:
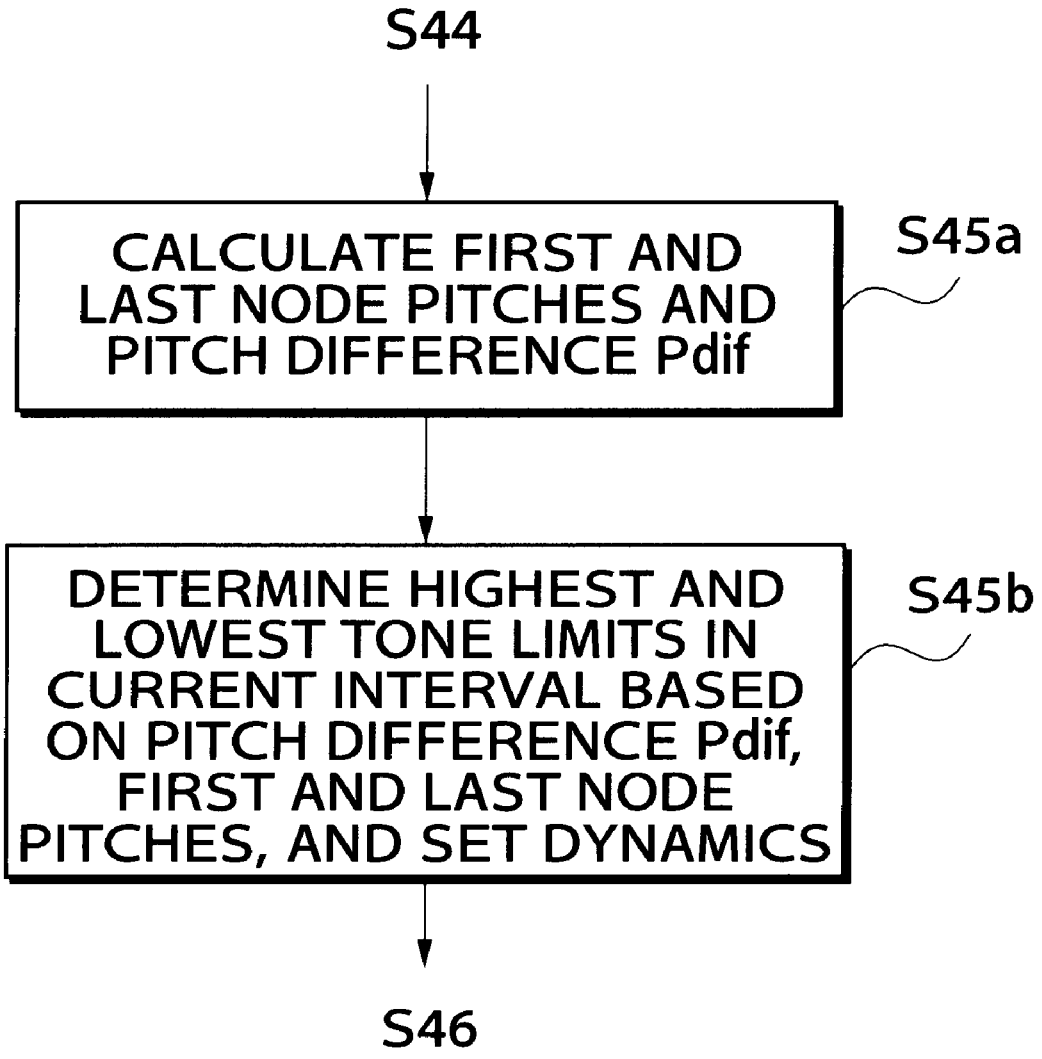
FIG. 16 is a flowchart showing a part of flow of a routine for generating pitches of tone-generation points between important tone-generation points, which routine is executed by an automatic composition apparatus according to another embodiment of the present invention.

The operation of the present embodiment for generating pitches of tone-generation points between the important tone-generation points is realized by replacing step S45 of FIG. 7 by steps S45*a* and S45*b* of FIG. 16. In FIG. 16, the difference (interval) Pdif between the first node pitch and the last node pitch is calculated in step S45*a,* and the highest and lowest tone limits of the current interval are determined in step S45*b,* based on the calculated difference (interval) Pdif, the first and last node pitches and the set dynamics.

Figure 17:
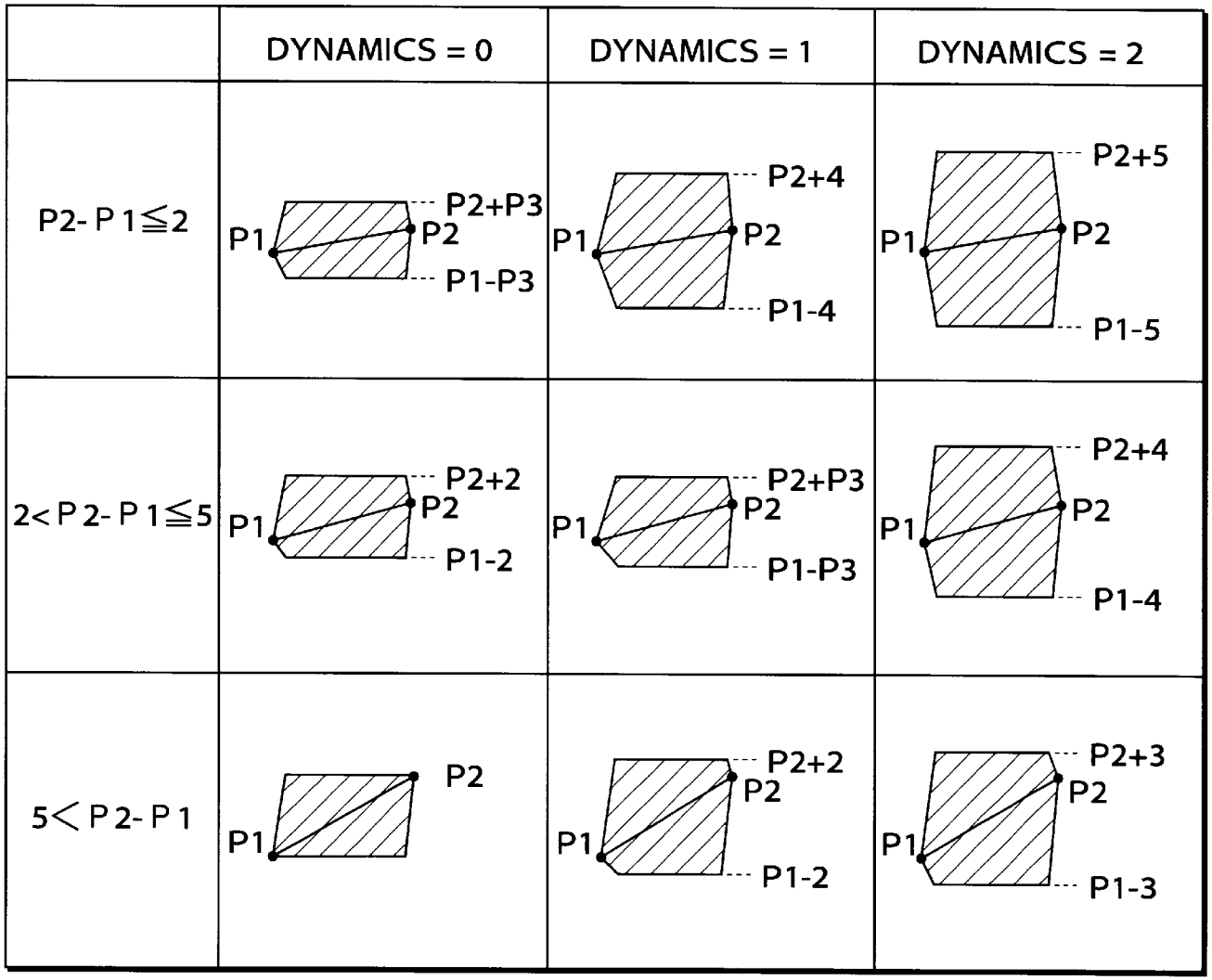
FIG. 17 is a view useful in explaining the process of determining the highest tone limit and the lowest tone limit of the interval in question, which routine is executed in the embodiment of FIG. 16.

FIG. 17 is a chart corresponding to FIG. 11, which is useful in explaining the operation for determining the highest tone limit and the lowest tone limit of the interval in question. The highest and lowest tone limits of the current interval that is defined between the first node pitch p1 and the last node pitch p2 is determined according to the pitch difference Pdif (=|p2−p1|; the unit is in degrees) and the value of the set dynamics, as indicated by hatched regions in FIG. 17.

1) Pdif≦2 a) Dynamics=0: The lowest tone limit is set to a pitch that is three degrees, for example, lower than the lower one of the first node pitch and the last node pitch (the first node pitch p1 in the example of FIG. 17), and the highest tone limit is set to a pitch that is three degrees, for example, higher than the other of the first and last node pitches (the last node pitch p2 in the example of FIG. 17).

b) Dynamics=1: The lowest tone limit is set to a pitch that is four degrees, for example, lower than the lower one of the first node pitch and the last node pitch (the first node pitch p1 in the example of FIG. 17), and the highest tone limit is set to a pitch that is four degrees, for example, higher than the other of the first and last node pitches (the last node pitch p2 in the example of FIG. 17).

c) Dynamics=2: The lowest tone limit is set to a pitch that is five degrees, for example, lower than the lower one of the first node pitch and the last node pitch (the first node pitch pl in the example of FIG. 17), and the highest tone limit is set to a pitch that is five degrees, for example, higher than the other of the first and last node pitches (the last node pitch p2 in the example of FIG. 17).

2) 2<Pdif≦5 a) Dynamics=0: The lowest tone limit is set to a pitch that is two degrees, for example, lower than the lower one of the first node pitch and the last node pitch (the first node pitch p1 in the example of FIG. 17), and the highest tone limit is set to a pitch that is two degrees, for example, higher than the other of the first and last node pitches (the last node pitch p2 in the example of FIG. 17).

b) Dynamics=1: The highest and lowest tone limits are determined in the same manner as in the case 1) a), except that the values of the determined lowest tone limit and highest tone limit are difference from those determined in the above case 1) a). This exception applies to the following cases.

c) Dynamics=2: The highest and lowest tone limits are determined in the same manner as in the case 1) b).

3) 5<Pdif a) Dynamics=0: The lowest tone limit is set to a pitch that is equal to the lower one of the first node pitch and the last node pitch (the first node pitch p1 in the example of FIG. 17), and the highest tone limit is set to a pitch equal to the other of the first and last node pitches (the last node pitch p2 in the example of FIG. 17).

b) Dynamics=1: The highest and lowest tone limits are determined in the same manner as in the case 2) a).

c) Dynamics=2: The highest and lowest tone limits are determined in the same manner as in the case 1) a).

Thus, in the present embodiment, the width between the highest tone limit and the lowest tone limit is determined according to, in particular, the pitch difference between the first node pitch and the last node pitch, so that pitches of tone-generation points between the important tone-generation points can be generated as desired or intended by the user.

While the degree by which the highest tone limit differs from the higher one of the first and last node pitches is made equal to the degree by which the lowest tone limit differs from the lower one of the first and last node pitches in the present embodiment, these degrees may be different from each other.

In the present embodiment, the value of the set dynamics is used as it is when the highest tone limit and the lowest tone limit of the current interval are determined (refer to step S45*b* in FIG. 16). It is, however, possible to change the value of the dynamics according to the calculated pitch difference Pdif (refer to step S202 of FIG. 18 as described later; where the pitch difference Pdif is small, the value of dynamics is changed to be larger than the set value), and determine the highest and lowest tone limits in the interval according to the value of the dynamics thus changed, and the first and last node pitches. In this case, too, substantially the same effect as described above can be obtained.

An automatic composition apparatus of a further embodiment of the present invention will be now described.

In each of the previous embodiments, when pitches of tone-generation points between adjacent important tone-generation points are generated, many tone-generation points having the same pitch are generated where a large number of syllables are included in the interval in question, and also the width between the highest and lowest tone limits in the interval is small, which results in a monotonous melody. The present embodiment has been developed so as to solve this problem.

Figure 18:
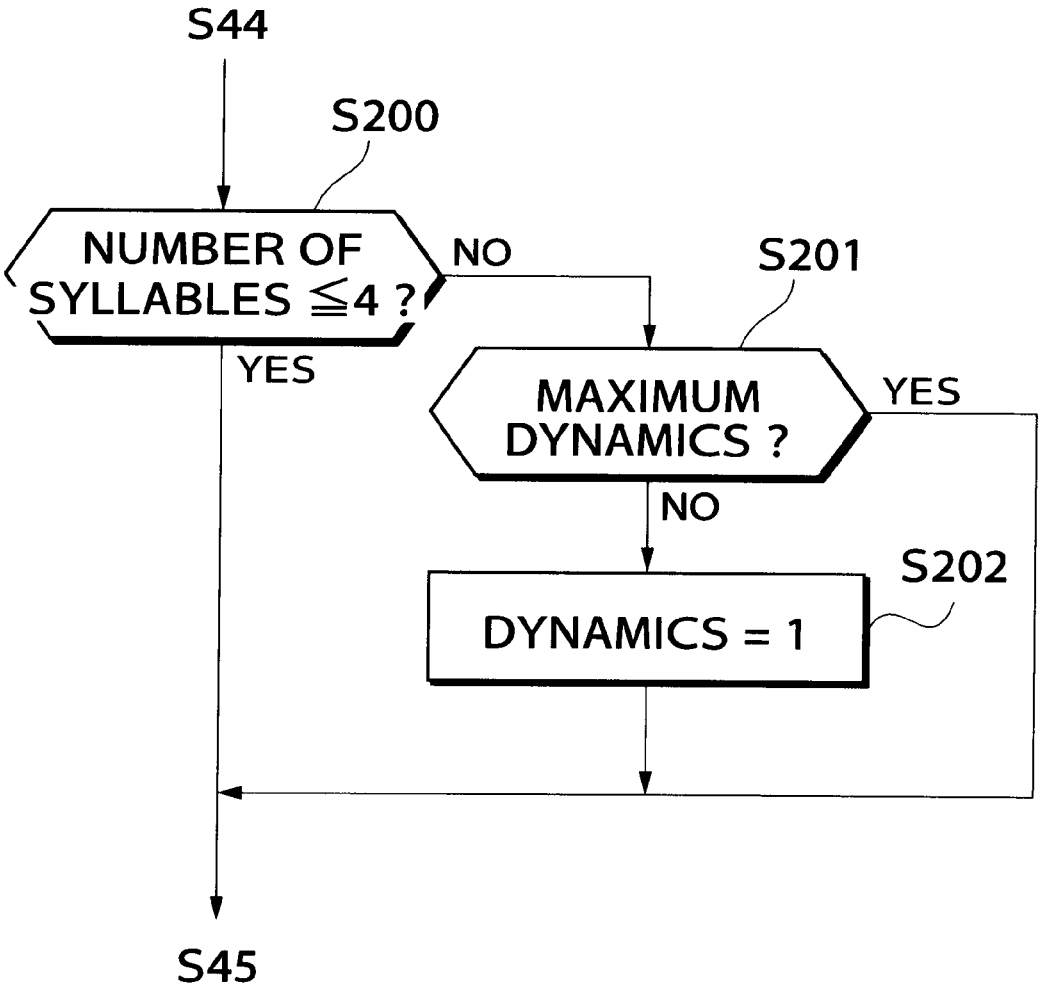
FIG. 18 is a flowchart showing a part of a routine for generating pitches of tone-generation points between important tone-generation points, which routine is executed by an automatic composition apparatus according to a further embodiment of the present invention.

In the automatic composition apparatus of the present embodiment, a process of FIG. 18 is added to the routine (as shown in FIG. 7) of the first embodiment for generating pitches of tone-generation points between adjacent important tone-generation points. More specifically, steps S200 to S202 of FIG. 18 are added between step S44 and step S45 of the routine of FIG. 7 for generating tone-generation pitches between important tone-generation points.

In FIG. 18, step S200 is executed to determine whether the number of syllables in the interval in question is four or smaller. If the number of syllables is equal to or smaller than four, the control flow goes straight to step S45. If the number of syllables is equal to or larger than five, the control flow goes to step S201.

In step S201, it is determined whether the currently set dynamics is the maximum value of dynamics that can be set. If it is not the maximum value, the dynamics value is incremented to "1" in step S202, and the control flow goes to step S45. If the currently set dynamics is the maximum value, the control flow goes to step S45 skipping step S202.

Thus, in the present embodiment, when a large number (5 or more) of syllables are included in the interval in question, the value of the dynamics is increased so that the width between the highest tone limit and the lowest tone limit of the interval is increased. As a result, an increased number of tone-generation points having different pitches are generated, and therefore pitches of tone-generation points between adjacent important tone-generation points can be generated as desired or intended by the user.

Although the value of the dynamics is not changed when the number of syllables included in the interval is small in the present embodiment, the present invention is not limited to this, but the value of the dynamics may be reduced (to "−1", for example) when the number of syllables is small (for example, equal to or smaller than 2).

While the value of an increase/decrease (increment or decrement) in the dynamics is fixedly set to ±1 in the illustrated embodiment, it may be changed according to the number of syllables, or may be set to other fixed value (for example, ±2 or +2 & −1).

Also, the width between the highest tone limit and lowest tone limit may be expanded according to the number of syllables, in a similar manner to the above case in which the width of the highest and lowest tone limits is expanded according to the pitch difference between the first node pitch and the last node pitch.

It is to be understood that the object of the present invention may also be accomplished by supplying a system or an apparatus with a storage medium in which a software program that realizes the functions of each of the illustrated embodiment is recorded, and causing a computer (CPU 5 or MPU) of the system or apparatus to read out and execute the program stored in the storage medium.

In this case, the program itself read from the storage medium accomplishes the novel functions of the present invention, and thus the storage medium storing the program constitutes the present invention.

The storage medium for supplying the above-described program to the system or apparatus may be selected from a hard disc mounted in the HDD 11, CD-ROM 21, MO, MD, floppy disc 20, CD-R (CD-Recordable), magnetic tape, non-volatile memory card, ROM, and others. The program may also be supplied from other MIDI equipment 100, or the server computer 102 via the communication network 101.

The functions of each of the illustrated embodiments may be accomplished not only by executing a program read by a computer, but also by causing an operating system (OS) that operates on the computer, to perform a part or the whole of the actual operations according to instructions of the program.

Furthermore, the program read from the storage medium may be written into a memory provided in an expanded board inserted in the computer, or an expanded unit connected to the computer, and a CPU, or the like, provided in the expanded board or expanded unit may actually perform part or all of the operations according to the instructions of the program, so as to accomplish the functions of the illustrated embodiment.

What is claimed is:

1. An automatic composition apparatus comprising:

a melody pitch generating device that generates melody pitches of a piece of music to be composed, so that the melody pitches satisfy first melody generation conditions that are less strict than second melody generation conditions; and an evaluation device that evaluates the melody pitches generated by said melody pitch generating device, in terms of the second melody generation conditions.

2. An automatic composition apparatus according to claim 1, wherein said first melody generation conditions include dynamics, and the number of syllables, and said second melody generation conditions include various musical rules, and the frequency of non-chord tones.

3. An automatic composition apparatus comprising:

a melody pitch generating device that generates melody pitches of a piece of music to be composed, for each of a plurality of sections into which the piece of music is divided, so that the melody pitches in each section satisfy first melody generation conditions that are less strict than second melody generation conditions;

a linking device that links said plurality of sections each comprising the melody pitches generated by said melody pitch generating device, in a direction of progression of the piece of music; and an evaluation device that evaluates the melody pitches of the plurality of sections linked by said linking device, in terms of the second melody generation conditions.

4. An automatic composition apparatus according to claim 3, wherein said first melody generation conditions include dynamics, and the number of syllables, and said second melody generation conditions include various musical rules, and the frequency of non-chord tones.

5. An automatic composition apparatus comprising:

a melody pitch generating device that generates melody pitches of a piece of music to be composed, so that the melody pitches satisfy predetermined melody generation conditions;

an evaluating device that evaluates the melody pitches generated by said melody pitch generating device; and a control device that adopts the melody pitches generated by said melody pitch generating device when the melody pitches pass evaluation of said evaluating device, and adopts the melody pitches after modification thereof, if possible, when the melody pitches fail to pass the evaluation of said evaluating device, said control device generating a command to said melody pitch generating device to generate melody pitches again when the melody pitches originally generated by said melody pitch generating device fail to pass the evaluation and modification thereof is impossible.

6. An automatic composition apparatus comprising:

a melody pitch generating device that generates melody pitches of a piece of music to be composed;

a skeleton node pitch generating device that generates skeleton node pitches that form a skeleton of the piece of music to be composed;

an important tone-generation point detecting device that detects important tone-generation points of the piece of music to be composed; and an allocating device that allocates the skeleton node pitches generated by said skeleton node pitch generating device, to the important tone-generation points detected by said important tone-generation point detecting device;

wherein said melody pitch generating device generates the melody pitches based on the skeleton node pitches allocated to the important tone-generation points.

7. An automatic composition apparatus according to claim 6, further comprising:

a pitch range information setting device that sets pitch range information used when generating melody pitches between the important tone-generation points, said pitch range information representing a pitch range in which the melody pitches are to be included after being generated; and a pitch difference calculating device that calculates a pitch difference between the skeleton node pitches;

wherein said melody pitch generating device generates the melody pitches between the important tone-generation points, according to the calculated pitch difference, the set pitch range information, and the skeleton node pitches.

8. An automatic composition apparatus according to claim 6, further comprising:

a pitch range information setting device that sets pitch range information used when generating melody pitches between the important tone-generation points, said pitch range information representing a pitch range in which the melody pitches are to be included after being generated; and a number-of-syllable setting device that sets a number of syllables between the important tone-generation points;

wherein said melody pitch generating device generates the melody pitches between the important tone-generation points, according to the set number of syllables, the set pitch range information, and the skeleton node pitches.

9. An automatic composition apparatus comprising:

a melody pitch generating device that generates melody pitches of a piece of music to be composed, said piece of music including pickup measures, and normal measures other than the pickup measures;

wherein said melody pitch generating device performs individual operations to generate melody pitches for the pickup measures and generate melody pitches for the normal measures, according to respective algorithms that are independent of each other.

10. An automatic composition apparatus comprising:

a melody pitch generating device that generates melody pitches of a piece of music to be composed; and a display device that displays the generated melody pitches within a narrow range relative to the whole piece of music, and also displays indications each of which represents the length of one phrase and may extend over a plurality of measures.

11. An automatic composition apparatus comprising:

a melody pitch generation device that generates melody pitches of a piece of music to be composed; and a display device that displays the generated melody pitches in a format in which one octave consists of seven tones that are scale tones of a key, said format including a #/♭ selection section in which sharp tones and flat tones, if any, are indicated, said display device being operable to display a selected one of # and ♭ in the #/♭ selection section when a corresponding one of the displayed melody pitches is other than said seven tones.

12. An automatic composition method comprising the steps of:

generating melody pitches of a piece of music to be composed, so that the melody pitches satisfy first melody generation conditions that are less strict than second melody generation conditions; and evaluating the generated melody pitches in terms of the second melody generation conditions.

13. An automatic composition method comprising the steps of:

generating melody pitches of a piece of music to be composed, for each of a plurality of sections into which the piece of music is divided, so that the melody pitches in each section satisfy first melody generation conditions that are less strict than second melody generation conditions;

linking said plurality of sections each comprising the generated melody pitches in a direction of progression of the piece of music; and evaluating the melody pitches of the linked plurality of sections in terms of the second melody generation conditions.

14. An automatic composition method comprising the steps of:

generating melody pitches of a piece of music to be composed, so that the melody pitches satisfy predetermined melody generation conditions;

evaluating the generated melody pitches; and adopting the generated melody pitches when the melody pitches pass said evaluation, and adopting the generated melody pitches after modification thereof, if possible, when the melody pitches fail to pass said evaluation, while causing said step of generating melody pitches of the piece of music to be composed to generate melody pitches again when the melody pitches originally generated by said step of generating melody pitches of the piece of music to be composed fail to pass the evaluation and modification thereof is impossible.

15. An automatic composition method comprising the steps of:

generating melody pitches of a piece of music to be composed;

generating skeleton node pitches that form a skeleton of the piece of music to be composed;

detecting important tone-generation points of the piece of music to be composed; and allocating the generated skeleton node pitches to the detected important tone-generation points;

wherein said step of generating melody pitches of the piece of music to be composed generates the melody pitches based on the skeleton node pitches allocated to the important tone-generation points.

16. An automatic composition method comprising the steps of:

generating melody pitches of a piece of music to be composed, said piece of music including pickup measures, and normal measures other than the pickup measures;

wherein said step of generating melody pitches of the piece of music to be composed performs individual operations to generate melody pitches for the pickup measures and generate melody pitches for the normal measures, according to respective algorithms that are independent of each other.

17. An automatic composition method comprising the steps of:

generating melody pitches of a piece of music to be composed; and displaying the generated melody pitches within a narrow range relative to the whole piece of music, and also displaying indications each of which represents the length of one phrase and may extend over a plurality of measures.

18. An automatic composition method comprising the steps of:

generating melody pitches of a piece of music to be composed; and displaying the generated melody pitches in a format in which one octave consists of seven tones that are scale tones of a key, said format including a #/♭ selection section in which sharp tones and flat tones, if any, are indicated, said step of displaying the generated melody pitches displaying a selected one of # and ♭ in the #/♭ selection section when a corresponding one of the displayed melody pitches is other than said seven tones.

19. A storage medium storing a program that is executable by a computer, comprising:

a melody pitch generating module that generates melody pitches of a piece of music to be composed, so that the melody pitches satisfy first melody generation conditions that are less strict than second melody generation conditions; and an evaluation module that evaluates the melody pitches generated by said melody pitch generating module, in terms of the second melody generation conditions.

20. A storage medium storing a program that is executable by a computer, comprising:

a melody pitch generating module that generates melody pitches of a piece of music to be composed, for each of a plurality of sections into which the piece of music is divided, so that the melody pitches in each section satisfy first melody generation conditions that are less strict than second melody generation conditions;

a linking module that links said plurality of sections each comprising the melody pitches generated by said melody pitch generating module, in a direction of progression of the piece of music; and an evaluation module that evaluates the melody pitches of the plurality of sections linked by said linking module, in terms of the second melody generation conditions.

21. A storage medium storing a program that is executable by a computer, comprising:

a melody pitch generating module that generates melody pitches of a piece of music so that the melody pitches satisfy predetermined melody generation conditions;

an evaluating module that evaluates the melody pitches generated by said melody pitch generating module; and a control module that adopts the melody pitches generated by said melody pitch generating module when the melody pitches pass evaluation of said evaluating module, and adopts the melody pitches after modification thereof, if possible, when the melody pitches fail to pass the evaluation of said evaluating module, said control module generating a command to said melody pitch generating module to generate melody pitches again when the melody pitches originally generated by said melody pitch generating module fail to pass the evaluation and modification thereof is impossible.

22. A storage medium storing a program that is executable by a computer, comprising:

a melody pitch generating module that generates melody pitches of a piece of music to be composed;

a skeleton node pitch generating module that generates skeleton node pitches that form a skeleton of the piece of music to be composed;

an important tone-generation point detecting module that detects important tone-generation points of the piece of music to be composed; and an allocating module that allocates the skeleton node pitches generated by said skeleton node pitch generating module, to the important tone-generation points detected by said important tone-generation point detecting module;

wherein said melody pitch generating module generates the melody pitches based on the skeleton node pitches allocated to the important tone-generation points.

23. A storage medium storing a program that is executable by a computer, comprising:

a melody pitch generating module that generates melody pitches of a piece of music to be composed, said piece of music including pickup measures and normal measures other than the pickup measures;

wherein said melody pitch generating module performs individual operations to generate melody pitches for the pickup measures and generate melody pitches for the normal measures, according to respective algorithms that are independent of each other.

* * * * *